US009082297B2

(12) United States Patent
Alexander

(10) Patent No.: US 9,082,297 B2
(45) Date of Patent: Jul. 14, 2015

(54) SYSTEM AND METHOD FOR VERIFYING PARAMETERS IN AN AUDIOVISUAL ENVIRONMENT

(75) Inventor: James M. Alexander, Santa Clara, CA (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 520 days.

(21) Appl. No.: 12/539,461

(22) Filed: Aug. 11, 2009

(65) Prior Publication Data

US 2011/0037636 A1 Feb. 17, 2011

(51) Int. Cl.
*G08C 23/04* (2006.01)

(52) U.S. Cl.
CPC ..... *G08C 23/04* (2013.01)

(58) Field of Classification Search
USPC ..... 348/181, 734
See application file for complete search history.

(56) References Cited

U.S. PATENT DOCUMENTS

| | | | |
|---|---|---|---|
| 2,911,462 | A | 11/1959 | Brady |
| D212,798 | S | 11/1968 | Dreyfuss |
| 3,793,489 | A | 2/1974 | Sank |
| 3,909,121 | A | 9/1975 | De Mesquita Cardoso |
| D270,271 | S | 8/1983 | Steele |
| 4,400,724 | A | 8/1983 | Fields |
| 4,473,285 | A | 9/1984 | Winter |
| 4,494,144 | A | 1/1985 | Brown |
| 4,750,123 | A | 6/1988 | Christian |
| 4,815,132 | A | 3/1989 | Minami |
| 4,827,253 | A | 5/1989 | Maltz |
| 4,853,764 | A | 8/1989 | Sutter |
| 4,890,314 | A | 12/1989 | Judd et al. |
| 4,961,211 | A | 10/1990 | Tsugane et al. |
| 4,994,912 | A | 2/1991 | Lumelsky et al. |

(Continued)

FOREIGN PATENT DOCUMENTS

| | | | |
|---|---|---|---|
| CN | 101383925 | A | 3/2009 |
| CN | 101953158 | A | 1/2011 |

(Continued)

OTHER PUBLICATIONS

Boccaccio, Jeff; CEPro, "Inside HDMI CEC: The Little-Known Control Feature," http://www.cepro.conn/article/print/inside_hdmi_cec_the_little_known_control_feature; Dec. 28, 2007, 2 pages.

(Continued)

*Primary Examiner* — Michael Teitelbaum
(74) *Attorney, Agent, or Firm* — Patent Capital Group

(57) ABSTRACT

A method is provided in one example embodiment and includes communicating a code to initiate cycling through a plurality of potential audiovisual inputs. The method includes receiving image data that is rendered on a display, the image data being based on a first one of the audiovisual inputs. The method also includes comparing the image data of the first one of the audiovisual inputs to a stored test pattern image associated with a selected audiovisual application to verify if the image data matches the stored test pattern for the selected audiovisual application. In more specific embodiments, the cycling through of the plurality of potential audiovisual inputs is terminated if the image data matches the stored test pattern for the selected audiovisual application. The code represents one or more infrared audiovisual commands being repeatedly sent to the display. The commands are sent until the stored test pattern image is detected on the display.

20 Claims, 3 Drawing Sheets

(56) References Cited

U.S. PATENT DOCUMENTS

| | | | |
|---|---|---|---|
| 5,003,532 | A | 3/1991 | Ashida et al. |
| 5,020,098 | A | 5/1991 | Celli |
| 5,033,969 | A | 7/1991 | Kamimura |
| 5,136,652 | A | 8/1992 | Jibbe et al. |
| 5,187,571 | A | 2/1993 | Braun et al. |
| 5,200,818 | A | 4/1993 | Neta et al. |
| 5,243,697 | A | 9/1993 | Hoeber et al. |
| 5,249,035 | A | 9/1993 | Yamanaka |
| 5,255,211 | A | 10/1993 | Redmond |
| D341,848 | S | 11/1993 | Bigelow et al. |
| 5,268,734 | A | 12/1993 | Parker et al. |
| 5,317,405 | A | 5/1994 | Kuriki et al. |
| 5,337,363 | A | 8/1994 | Platt |
| 5,347,363 | A | 9/1994 | Yamanaka |
| 5,351,067 | A | 9/1994 | Lumelsky et al. |
| 5,359,362 | A | 10/1994 | Lewis et al. |
| D357,468 | S | 4/1995 | Rodd |
| 5,406,326 | A | 4/1995 | Mowry |
| 5,423,554 | A | 6/1995 | Davis |
| 5,446,834 | A | 8/1995 | Deering |
| 5,448,287 | A | 9/1995 | Hull |
| 5,467,401 | A | 11/1995 | Nagamitsu et al. |
| 5,495,576 | A | 2/1996 | Ritchey |
| 5,502,481 | A | 3/1996 | Dentinger et al. |
| 5,502,726 | A | 3/1996 | Fischer |
| 5,506,604 | A | 4/1996 | Nally et al. |
| 5,532,737 | A | 7/1996 | Braun |
| 5,541,639 | A | 7/1996 | Takatsuki et al. |
| 5,541,773 | A | 7/1996 | Kamo et al. |
| 5,570,372 | A | 10/1996 | Shaffer |
| 5,572,248 | A | 11/1996 | Allen et al. |
| 5,587,726 | A | 12/1996 | Moffat |
| 5,612,733 | A | 3/1997 | Flohr |
| 5,625,410 | A | 4/1997 | Washino et al. |
| 5,666,153 | A | 9/1997 | Copeland |
| 5,673,401 | A | 9/1997 | Volk et al. |
| 5,675,374 | A | 10/1997 | Kohda |
| 5,689,663 | A | 11/1997 | Williams |
| 5,708,787 | A | 1/1998 | Nakano et al. |
| 5,713,033 | A | 1/1998 | Sado |
| 5,715,377 | A | 2/1998 | Fukushima et al. |
| D391,558 | S | 3/1998 | Marshall et al. |
| D391,935 | S | 3/1998 | Sakaguchi et al. |
| D392,269 | S | 3/1998 | Mason et al. |
| 5,729,471 | A | 3/1998 | Jain et al. |
| 5,737,011 | A | 4/1998 | Lukacs |
| 5,745,116 | A | 4/1998 | Pisutha-Arnond |
| 5,748,121 | A | 5/1998 | Romriell |
| D395,292 | S | 6/1998 | Vu |
| 5,760,826 | A | 6/1998 | Nayar |
| D396,455 | S | 7/1998 | Bier |
| D396,456 | S | 7/1998 | Bier |
| 5,790,182 | A | 8/1998 | Hilaire |
| 5,796,724 | A | 8/1998 | Rajamani et al. |
| D397,687 | S | 9/1998 | Arora et al. |
| D398,595 | S | 9/1998 | Baer et al. |
| 5,815,196 | A | 9/1998 | Alshawi |
| D399,501 | S | 10/1998 | Arora et al. |
| 5,818,514 | A | 10/1998 | Duttweiler et al. |
| 5,821,985 | A | 10/1998 | Iizawa |
| 5,825,362 | A | 10/1998 | Retter |
| D406,124 | S | 2/1999 | Newton et al. |
| 5,889,499 | A | 3/1999 | Nally et al. |
| 5,894,321 | A | 4/1999 | Downs et al. |
| D409,243 | S | 5/1999 | Lonergan |
| D410,447 | S | 6/1999 | Chang |
| 5,920,693 | A | 7/1999 | Burkman et al. |
| 5,929,857 | A | 7/1999 | Dinallo et al. |
| 5,940,118 | A | 8/1999 | Van Schyndel |
| 5,940,530 | A | 8/1999 | Fukushima et al. |
| 5,953,052 | A | 9/1999 | McNelley et al. |
| 5,956,100 | A | 9/1999 | Gorski |
| 5,996,003 | A | 11/1999 | Namikata et al. |
| D419,543 | S | 1/2000 | Warren et al. |
| D420,995 | S | 2/2000 | Imamura et al. |
| 6,069,648 | A | 5/2000 | Suso et al. |
| 6,069,658 | A | 5/2000 | Watanabe |
| 6,088,045 | A | 7/2000 | Lumelsky et al. |
| 6,097,390 | A | 8/2000 | Marks |
| 6,097,441 | A | 8/2000 | Allport |
| 6,101,113 | A | 8/2000 | Paice |
| 6,124,896 | A | 9/2000 | Kurashige |
| 6,137,485 | A | 10/2000 | Kawai et al. |
| 6,148,092 | A | 11/2000 | Qian |
| D435,561 | S | 12/2000 | Pettigrew et al. |
| 6,167,162 | A | 12/2000 | Jacquin et al. |
| 6,172,703 | B1 | 1/2001 | Lee |
| 6,173,069 | B1 | 1/2001 | Daly et al. |
| D438,873 | S | 3/2001 | Wang et al. |
| D440,575 | S | 4/2001 | Wang et al. |
| 6,211,870 | B1 | 4/2001 | Foster |
| 6,226,035 | B1 | 5/2001 | Korein et al. |
| 6,243,130 | B1 | 6/2001 | McNelley et al. |
| 6,249,318 | B1 | 6/2001 | Girod et al. |
| 6,256,400 | B1 | 7/2001 | Takata et al. |
| 6,259,469 | B1 | 7/2001 | Ejima et al. |
| 6,266,082 | B1 | 7/2001 | Yonezawa et al. |
| 6,266,098 | B1 | 7/2001 | Cove et al. |
| D446,790 | S | 8/2001 | Wang et al. |
| 6,285,392 | B1 | 9/2001 | Satoda et al. |
| 6,292,188 | B1 | 9/2001 | Carlson et al. |
| 6,292,575 | B1 | 9/2001 | Bortolussi et al. |
| D450,323 | S | 11/2001 | Moore et al. |
| D453,167 | S | 1/2002 | Hasegawa et al. |
| 6,344,874 | B1 | 2/2002 | Helms et al. |
| D454,574 | S | 3/2002 | Wasko et al. |
| 6,356,589 | B1 | 3/2002 | Gebler et al. |
| 6,380,539 | B1 | 4/2002 | Edgar |
| 6,396,514 | B1 | 5/2002 | Kohno |
| 6,424,377 | B1 | 7/2002 | Driscoll, Jr. |
| D461,191 | S | 8/2002 | Hickey et al. |
| 6,430,222 | B1 | 8/2002 | Okadia |
| 6,459,451 | B2 | 10/2002 | Driscoll et al. |
| 6,462,767 | B1 | 10/2002 | Obata et al. |
| 6,493,032 | B1 | 12/2002 | Wallerstein et al. |
| D468,322 | S | 1/2003 | Walker et al. |
| 6,507,356 | B1 | 1/2003 | Jackel et al. |
| D470,153 | S | 2/2003 | Billmaier et al. |
| 6,515,695 | B1 | 2/2003 | Sato et al. |
| D474,194 | S | 5/2003 | Kates et al. |
| 6,573,904 | B1 | 6/2003 | Chun et al. |
| 6,577,333 | B2 | 6/2003 | Tai et al. |
| 6,583,808 | B2 | 6/2003 | Boulanger et al. |
| 6,590,603 | B2 | 7/2003 | Sheldon et al. |
| 6,591,314 | B1 * | 7/2003 | Colbath ..... 710/36 |
| 6,593,955 | B1 | 7/2003 | Falcon |
| 6,593,956 | B1 | 7/2003 | Potts et al. |
| D478,090 | S | 8/2003 | Nguyen et al. |
| D478,912 | S | 8/2003 | Johnson |
| 6,611,281 | B2 | 8/2003 | Strubbe |
| 6,614,781 | B1 | 9/2003 | Elliott et al. |
| D482,368 | S | 11/2003 | den Toonder et al. |
| 6,680,856 | B2 | 1/2004 | Schreiber |
| 6,693,663 | B1 | 2/2004 | Harris |
| 6,694,094 | B2 | 2/2004 | Partynski et al. |
| 6,704,048 | B1 | 3/2004 | Malkin et al. |
| 6,710,797 | B1 | 3/2004 | McNelley et al. |
| 6,751,106 | B2 | 6/2004 | Zhang et al. |
| D492,692 | S | 7/2004 | Fallon et al. |
| 6,763,226 | B1 | 7/2004 | McZeal |
| 6,768,722 | B1 | 7/2004 | Katseff et al. |
| D494,186 | S | 8/2004 | Johnson |
| 6,771,303 | B2 | 8/2004 | Zhang et al. |
| 6,774,927 | B1 | 8/2004 | Cohen et al. |
| D495,715 | S | 9/2004 | Gildred |
| 6,795,108 | B2 | 9/2004 | Jarboe et al. |
| 6,795,558 | B2 | 9/2004 | Matsuo et al. |
| 6,798,834 | B1 | 9/2004 | Murakami et al. |
| 6,801,637 | B2 | 10/2004 | Voronka et al. |
| 6,806,898 | B1 | 10/2004 | Toyama et al. |
| 6,807,280 | B1 | 10/2004 | Stroud et al. |
| 6,809,724 | B1 | 10/2004 | Shiraishi et al. |
| 6,831,653 | B2 | 12/2004 | Kehlet et al. |
| 6,844,990 | B2 | 1/2005 | Artonne et al. |

(56) References Cited

U.S. PATENT DOCUMENTS 6,850,266 B1 2/2005 Trinca
6,853,398 B2 2/2005 Malzbender et al.
6,867,798 B1 3/2005 Wada et al.
6,882,358 B1 4/2005 Schuster et al.
6,888,358 B2 5/2005 Lechner et al.
D506,208 S 6/2005 Jewitt et al.
6,909,438 B1 6/2005 White et al.
6,911,995 B2 6/2005 Ivanov et al.
6,917,271 B2 7/2005 Zhang et al.
6,922,718 B2 7/2005 Chang
6,925,613 B2 8/2005 Gibson
6,963,653 B1 11/2005 Miles
D512,723 S 12/2005 Wirz
6,980,526 B2 12/2005 Jang et al.
6,985,178 B1 1/2006 Morita et al.
6,989,754 B2 1/2006 Kiscanin et al.
6,989,836 B2 1/2006 Ramsey
6,989,856 B2 1/2006 Firestone et al.
6,990,086 B1 1/2006 Holur et al.
7,002,973 B2 2/2006 MeLampy et al.
7,023,855 B2 4/2006 Haumont et al.
7,028,092 B2 4/2006 MeLampy et al.
7,030,890 B1 4/2006 Jouet et al.
7,031,311 B2 4/2006 MeLampy et al.
7,036,092 B2 4/2006 Sloo et al.
D521,521 S 5/2006 Jewitt et al.
7,043,528 B2 5/2006 Schmitt et al.
7,046,862 B2 5/2006 Ishizaka et al.
D522,559 S 6/2006 Naito et al.
7,057,636 B1 6/2006 Cohen-Solal et al.
7,057,662 B2 6/2006 Malzbender
7,058,690 B2 6/2006 Maehiro
7,061,896 B2 6/2006 Jabbari et al.
D524,321 S 7/2006 Hally et al.
7,072,504 B2 7/2006 Miyano et al.
7,072,833 B2 7/2006 Rajan
7,080,157 B2 7/2006 McCanne
7,092,002 B2 8/2006 Ferren et al.
7,095,455 B2 * 8/2006 Jordan et al. ..... 348/734
7,111,045 B2 9/2006 Kato et al.
7,126,627 B1 10/2006 Lewis et al.
7,131,135 B1 * 10/2006 Virag et al. ..... 725/80
7,136,651 B2 11/2006 Kalavade
7,139,767 B1 11/2006 Taylor et al.
D533,525 S 12/2006 Arie
D533,852 S 12/2006 Ma
D534,511 S 1/2007 Maeda et al.
D535,954 S 1/2007 Hwang et al.
D536,001 S 1/2007 Armstrong et al.
7,158,674 B2 1/2007 Suh
7,161,942 B2 1/2007 Chen et al.
7,164,435 B2 1/2007 Wang et al.
D536,340 S 2/2007 Jost et al.
D539,243 S 3/2007 Chiu et al.
7,197,008 B1 3/2007 Shabtay et al.
D540,336 S 4/2007 Kim et al.
D541,773 S 5/2007 Chong et al.
D542,247 S 5/2007 Kinoshita et al.
7,221,260 B2 5/2007 Berezowski et al.
D544,494 S 6/2007 Cummins
D545,314 S 6/2007 Kim
D547,320 S 7/2007 Kim et al.
7,239,338 B2 7/2007 Krisbergh et al.
7,246,118 B2 7/2007 Chastain et al.
D548,742 S 8/2007 Fletcher
7,254,785 B2 8/2007 Reed
D550,635 S 9/2007 DeMaio et al.
D551,184 S 9/2007 Kanou et al.
D551,672 S 9/2007 Wirz
7,269,292 B2 9/2007 Steinberg
7,274,555 B2 9/2007 Kim et al.
D554,664 S 11/2007 Van Dongen et al.
D555,610 S 11/2007 Yang et al.
D559,265 S 1/2008 Armstrong et al.
D560,225 S 1/2008 Park et al.
D560,681 S 1/2008 Fletcher
D561,130 S 2/2008 Won et al.
7,336,299 B2 2/2008 Kostrzewski
D563,965 S 3/2008 Van Dongen et al.
D564,530 S 3/2008 Kim et al.
D567,202 S 4/2008 Rieu Piquet
7,352,809 B2 4/2008 Wenger et al.
7,353,279 B2 4/2008 Durvasula et al.
7,353,462 B2 4/2008 Caffarelli
7,359,731 B2 4/2008 Choksi
D574,392 S 8/2008 Kwag et al.
7,411,975 B1 8/2008 Mohaban
7,413,150 B1 8/2008 Hsu
7,428,000 B2 9/2008 Cutler et al.
D578,496 S 10/2008 Leonard
7,440,615 B2 10/2008 Gong et al.
D580,451 S 11/2008 Steele et al.
7,450,134 B2 11/2008 Maynard et al.
7,471,320 B2 12/2008 Malkin et al.
D585,453 S 1/2009 Chen et al.
7,477,322 B2 1/2009 Hsieh
7,477,657 B1 1/2009 Murphy et al.
7,480,870 B2 1/2009 Anzures et al.
D588,560 S 3/2009 Mellingen et al.
D589,053 S 3/2009 Steele et al.
7,505,036 B1 3/2009 Baldwin
D591,306 S 4/2009 Setiawan et al.
7,518,051 B2 4/2009 Redmann
D592,621 S 5/2009 Han
7,529,425 B2 5/2009 Kitamura et al.
7,532,230 B2 5/2009 Culbertson et al.
7,532,232 B2 5/2009 Shah et al.
7,534,056 B2 5/2009 Cross et al.
7,545,761 B1 6/2009 Kalbag
7,551,432 B1 6/2009 Bockheim et al.
7,555,141 B2 6/2009 Mori
D595,728 S 7/2009 Scheibe et al.
D596,646 S 7/2009 Wani
7,575,537 B2 8/2009 Ellis
7,577,246 B2 8/2009 Idan et al.
D602,033 S 10/2009 Vu et al.
D602,453 S 10/2009 Ding et al.
D602,495 S 10/2009 Um et al.
7,607,101 B1 10/2009 Barrus
7,610,352 B2 10/2009 AlHusseini et al.
7,610,599 B1 10/2009 Nashida et al.
7,616,226 B2 11/2009 Roessler et al.
7,623,115 B2 11/2009 Marks
7,624,417 B2 11/2009 Dua
D608,788 S 1/2010 Meziere
7,646,419 B2 1/2010 Cernasov
D610,560 S 2/2010 Chen
7,661,075 B2 2/2010 Lahdesmaki
7,664,750 B2 2/2010 Frees et al.
D612,394 S 3/2010 La et al.
7,676,763 B2 3/2010 Rummel
7,679,639 B2 3/2010 Harrell et al.
7,692,680 B2 4/2010 Graham
7,707,247 B2 4/2010 Dunn et al.
D615,514 S 5/2010 Mellingen et al.
7,710,448 B2 5/2010 De Beer et al.
7,710,450 B2 5/2010 Dhuey et al.
7,714,222 B2 5/2010 Taub et al.
7,715,657 B2 5/2010 Lin et al.
7,716,283 B2 5/2010 Thukral
7,719,605 B2 5/2010 Hirasawa et al.
7,719,662 B2 5/2010 Bamji et al.
7,720,277 B2 5/2010 Hattori
7,725,919 B1 5/2010 Thiagarajan et al.
D617,806 S 6/2010 Christie et al.
7,738,457 B2 6/2010 Nordmark et al.
D619,608 S 7/2010 Meziere
D619,609 S 7/2010 Meziere
D619,610 S 7/2010 Meziere
D619,611 S 7/2010 Meziere
7,752,568 B2 7/2010 Park et al.
D621,410 S 8/2010 Verfuerth et al.
D626,102 S 10/2010 Buzzard et al.
D626,103 S 10/2010 Buzzard et al.

(56) References Cited

U.S. PATENT DOCUMENTS 7,813,724 B2 10/2010 Gronner et al.
D628,175 S 11/2010 Desai et al.
7,839,434 B2 11/2010 Ciudad et al.
D628,968 S 12/2010 Desai et al.
7,855,726 B2 12/2010 Ferren et al.
7,861,189 B2 12/2010 Watanabe et al.
D631,891 S 2/2011 Vance et al.
D632,698 S 2/2011 Judy et al.
7,886,048 B1 2/2011 Holland et al.
7,889,851 B2 2/2011 Shah et al.
7,890,888 B2 2/2011 Glasgow et al.
7,894,531 B1 2/2011 Cetin et al.
D634,726 S 3/2011 Harden et al.
D634,753 S 3/2011 Loretan et al.
7,899,265 B1 3/2011 Rostami
D635,569 S 4/2011 Park
D635,975 S 4/2011 Seo et al.
7,920,158 B1 4/2011 Beck et al.
D637,199 S 5/2011 Brinda
D638,025 S 5/2011 Saft et al.
D638,850 S 5/2011 Woods et al.
D638,853 S 5/2011 Brinda
7,939,959 B2 5/2011 Wagoner
D640,268 S 6/2011 Jones et al.
D642,184 S 7/2011 Brouwers et al.
7,990,422 B2 8/2011 Ahiska et al.
7,996,775 B2 8/2011 Cole et al.
8,000,559 B2 8/2011 Kwon
D646,690 S 10/2011 Thai et al.
D648,734 S 11/2011 Christie et al.
D649,556 S 11/2011 Judy et al.
8,077,857 B1 12/2011 Lambert
8,081,346 B1 12/2011 Anup et al.
8,086,076 B2 12/2011 Tian et al.
D652,050 S 1/2012 Chaudhri
D652,429 S 1/2012 Steele et al.
D654,926 S 2/2012 Lipman et al.
D656,513 S 3/2012 Thai et al.
8,132,100 B2 3/2012 Seo et al.
8,135,068 B1 3/2012 Alvarez
D656,948 S 4/2012 Knudsen et al.
D660,313 S 5/2012 Williams et al.
8,179,419 B2 5/2012 Girish et al.
8,209,632 B2 6/2012 Reid et al.
8,219,404 B2 7/2012 Weinberg et al.
8,219,920 B2 7/2012 Langoulant et al.
D664,985 S 8/2012 Tanghe et al.
8,259,155 B2 9/2012 Marathe et al.
D669,086 S 10/2012 Boyer et al.
D669,088 S 10/2012 Boyer et al.
D669,913 S 10/2012 Maggiotto et al.
8,289,363 B2 10/2012 Buckler
8,294,747 B1 10/2012 Weinberg et al.
8,299,979 B2 10/2012 Rambo et al.
D670,723 S 11/2012 Khan et al.
D671,136 S 11/2012 Barnett et al.
D671,141 S 11/2012 Peters et al.
8,315,466 B2 11/2012 El-Maleh et al.
8,339,499 B2 12/2012 Ohuchi
8,363,719 B2 1/2013 Nakayama
8,436,888 B1 5/2013 Baldino et al.
8,614,735 B2 12/2013 Buckler
2002/0047892 A1 4/2002 Gonsalves
2002/0106120 A1 8/2002 Brandenburg et al.
2002/0108125 A1 8/2002 Joao
2002/0113827 A1 8/2002 Perlman et al.
2002/0114392 A1 8/2002 Sekiguchi et al.
2002/0118890 A1 8/2002 Rondinelli
2002/0131608 A1 9/2002 Lobb et al.
2002/0140804 A1 10/2002 Colmenarez et al.
2002/0149672 A1 10/2002 Clapp et al.
2002/0163538 A1 11/2002 Shteyn
2002/0186528 A1 12/2002 Huang
2002/0196737 A1 12/2002 Bullard
2003/0017872 A1 1/2003 Oishi et al.
2003/0048218 A1 3/2003 Milnes et al.
2003/0071932 A1 4/2003 Tanigaki
2003/0072460 A1 4/2003 Gonopolskiy et al.
2003/0160861 A1 8/2003 Barlow et al.
2003/0179285 A1 9/2003 Naito
2003/0185303 A1 10/2003 Hall
2003/0197687 A1 10/2003 Shetter
2003/0220971 A1 11/2003 Kressin
2004/0003411 A1 1/2004 Nakai et al.
2004/0032906 A1 2/2004 Lillig
2004/0038169 A1 2/2004 Mandelkern et al.
2004/0039778 A1 2/2004 Read et al.
2004/0061787 A1 4/2004 Liu et al.
2004/0091232 A1 5/2004 Appling, III
2004/0118984 A1 6/2004 Kim et al.
2004/0119814 A1 6/2004 Clisham et al.
2004/0164858 A1 8/2004 Lin
2004/0165060 A1 8/2004 McNelley et al.
2004/0178955 A1 9/2004 Menache et al.
2004/0189463 A1* 9/2004 Wathen ..... 340/539.1
2004/0189676 A1 9/2004 Dischert
2004/0196250 A1* 10/2004 Mehrotra et al. ..... 345/102
2004/0207718 A1 10/2004 Boyden et al.
2004/0218755 A1 11/2004 Marton et al.
2004/0221243 A1 11/2004 Twerdahl et al.
2004/0246962 A1 12/2004 Kopeikin et al.
2004/0246972 A1 12/2004 Wang et al.
2004/0254982 A1 12/2004 Hoffman et al.
2004/0260796 A1 12/2004 Sundqvist et al.
2005/0007954 A1 1/2005 Sreemanthula et al.
2005/0022130 A1 1/2005 Fabritius
2005/0024484 A1 2/2005 Leonard
2005/0034084 A1 2/2005 Ohtsuki et al.
2005/0039142 A1 2/2005 Jalon et al.
2005/0050246 A1 3/2005 Lakkakorpi et al.
2005/0081160 A1 4/2005 Wee et al.
2005/0099492 A1 5/2005 Orr
2005/0110867 A1 5/2005 Schulz
2005/0117022 A1 6/2005 Marchant
2005/0129325 A1 6/2005 Wu
2005/0147257 A1 7/2005 Melchior et al.
2005/0149872 A1 7/2005 Fong et al.
2005/0154988 A1 7/2005 Proehl et al.
2005/0223069 A1 10/2005 Cooperman et al.
2005/0235209 A1 10/2005 Morita et al.
2005/0248652 A1 11/2005 Firestone et al.
2005/0251760 A1 11/2005 Sato et al.
2005/0268823 A1 12/2005 Bakker et al.
2006/0013495 A1 1/2006 Duan et al.
2006/0017807 A1 1/2006 Lee et al.
2006/0028983 A1 2/2006 Wright
2006/0029084 A1 2/2006 Grayson
2006/0038878 A1 2/2006 Takashima et al.
2006/0048070 A1 3/2006 Taylor et al.
2006/0056056 A1 3/2006 Ahiska et al.
2006/0066717 A1 3/2006 Miceli
2006/0072813 A1 4/2006 Matsumoto et al.
2006/0082643 A1 4/2006 Richards
2006/0093128 A1 5/2006 Oxford
2006/0100004 A1 5/2006 Kim et al.
2006/0104297 A1 5/2006 Buyukkoc et al.
2006/0104470 A1 5/2006 Akino
2006/0120307 A1 6/2006 Sahashi
2006/0120568 A1 6/2006 McConville et al.
2006/0125691 A1 6/2006 Menache et al.
2006/0126878 A1 6/2006 Takumai et al.
2006/0126894 A1 6/2006 Mori
2006/0152489 A1 7/2006 Sweetser et al.
2006/0152575 A1 7/2006 Amiel et al.
2006/0158509 A1 7/2006 Kenoyer et al.
2006/0168302 A1 7/2006 Boskovic et al.
2006/0170769 A1 8/2006 Zhou
2006/0181607 A1 8/2006 McNelley et al.
2006/0200518 A1 9/2006 Sinclair et al.
2006/0233120 A1 10/2006 Eshel et al.
2006/0256187 A1 11/2006 Sheldon et al.
2006/0284786 A1 12/2006 Takano et al.
2006/0289772 A1 12/2006 Johnson et al.
2007/0019621 A1 1/2007 Perry et al.

(56) References Cited

U.S. PATENT DOCUMENTS

2007/0022388 A1 1/2007 Jennings
2007/0039030 A1 2/2007 Romanowich et al.
2007/0040903 A1 2/2007 Kawaguchi
2007/0070177 A1 3/2007 Christensen
2007/0074123 A1 3/2007 Omura et al.
2007/0080845 A1* 4/2007 Amand ..... 341/176
2007/0112966 A1 5/2007 Eftis et al.
2007/0120971 A1 5/2007 Kennedy
2007/0121353 A1 5/2007 Zhang et al.
2007/0140337 A1 6/2007 Lim et al.
2007/0153712 A1 7/2007 Fry et al.
2007/0157119 A1 7/2007 Bishop
2007/0159523 A1 7/2007 Hillis et al.
2007/0162866 A1 7/2007 Matthews et al.
2007/0183661 A1 8/2007 El-Maleh et al.
2007/0188597 A1 8/2007 Kenoyer et al.
2007/0189219 A1 8/2007 Navoli et al.
2007/0192381 A1 8/2007 Padmanabhan
2007/0206091 A1 9/2007 Dunn et al.
2007/0206556 A1 9/2007 Yegani et al.
2007/0206602 A1 9/2007 Halabi et al.
2007/0211716 A1 9/2007 Oz et al.
2007/0217406 A1 9/2007 Riedel et al.
2007/0217500 A1 9/2007 Gao et al.
2007/0229250 A1* 10/2007 Recker et al. ..... 340/531
2007/0240073 A1 10/2007 McCarthy et al.
2007/0247470 A1 10/2007 Dhuey et al.
2007/0250567 A1 10/2007 Graham et al.
2007/0250620 A1 10/2007 Shah et al.
2007/0273752 A1 11/2007 Chambers et al.
2007/0279483 A1 12/2007 Beers et al.
2007/0279484 A1 12/2007 Derocher et al.
2007/0285505 A1 12/2007 Korneliussen
2007/0291667 A1 12/2007 Huber et al.
2008/0043041 A2 2/2008 Hedenstroem et al.
2008/0044064 A1 2/2008 His
2008/0046840 A1 2/2008 Melton et al.
2008/0068446 A1 3/2008 Barkley et al.
2008/0069444 A1 3/2008 Wilensky
2008/0077390 A1 3/2008 Nagao
2008/0077883 A1 3/2008 Kim et al.
2008/0084429 A1 4/2008 Wissinger
2008/0119211 A1 5/2008 Paas et al.
2008/0134098 A1 6/2008 Hoglund et al.
2008/0136896 A1 6/2008 Graham et al.
2008/0148187 A1 6/2008 Miyata et al.
2008/0151038 A1 6/2008 Khouri et al.
2008/0153537 A1 6/2008 Khawand et al.
2008/0167078 A1 7/2008 Eibye
2008/0198755 A1 8/2008 Vasseur et al.
2008/0208444 A1 8/2008 Ruckart
2008/0212677 A1 9/2008 Chen et al.
2008/0215974 A1 9/2008 Harrison et al.
2008/0215993 A1 9/2008 Rossman
2008/0218582 A1 9/2008 Buckler
2008/0219268 A1 9/2008 Dennison
2008/0232688 A1 9/2008 Senior et al.
2008/0232692 A1 9/2008 Kaku
2008/0240237 A1 10/2008 Tian et al.
2008/0240571 A1 10/2008 Tian et al.
2008/0246833 A1 10/2008 Yasui et al.
2008/0256474 A1 10/2008 Chakra et al.
2008/0261569 A1 10/2008 Britt et al.
2008/0266380 A1 10/2008 Gorzynski et al.
2008/0267282 A1 10/2008 Kalipatnapu et al.
2008/0276184 A1 11/2008 Buffet et al.
2008/0297586 A1 12/2008 Kurtz et al.
2008/0298571 A1 12/2008 Kurtz et al.
2008/0303901 A1 12/2008 Variyath et al.
2009/0003723 A1 1/2009 Kokemohr
2009/0009593 A1 1/2009 Cameron et al.
2009/0012633 A1 1/2009 Liu et al.
2009/0037827 A1 2/2009 Bennetts
2009/0051756 A1 2/2009 Trachtenberg
2009/0079812 A1 3/2009 Crenshaw et al.
2009/0096573 A1 4/2009 Graessley
2009/0115723 A1 5/2009 Henty
2009/0119603 A1 5/2009 Stackpole
2009/0122867 A1 5/2009 Mauchly et al.
2009/0129753 A1 5/2009 Wagenlander
2009/0147070 A1 6/2009 Marathe et al.
2009/0172596 A1 7/2009 Yamashita
2009/0174764 A1 7/2009 Chadha et al.
2009/0183122 A1 7/2009 Webb et al.
2009/0193345 A1 7/2009 Wensley et al.
2009/0204538 A1 8/2009 Ley et al.
2009/0207179 A1 8/2009 Huang et al.
2009/0207233 A1 8/2009 Mauchly et al.
2009/0207234 A1 8/2009 Chen et al.
2009/0217199 A1 8/2009 Hara et al.
2009/0228807 A1 9/2009 Lemay
2009/0244257 A1 10/2009 MacDonald et al.
2009/0256901 A1 10/2009 Mauchly et al.
2009/0260060 A1 10/2009 Smith et al.
2009/0265628 A1 10/2009 Bamford et al.
2009/0279476 A1 11/2009 Li et al.
2009/0324008 A1 12/2009 Kongqiao et al.
2009/0324023 A1 12/2009 Tian et al.
2010/0005419 A1 1/2010 Miichi et al.
2010/0008373 A1 1/2010 Xiao et al.
2010/0014530 A1 1/2010 Cutaia
2010/0027907 A1 2/2010 Cherna et al.
2010/0030389 A1 2/2010 Palmer et al.
2010/0042281 A1 2/2010 Filla
2010/0049542 A1 2/2010 Benjamin et al.
2010/0079355 A1 4/2010 Kilpatrick et al.
2010/0118112 A1 5/2010 Nimri et al.
2010/0123770 A1 5/2010 Friel et al.
2010/0149301 A1 6/2010 Lee et al.
2010/0153853 A1 6/2010 Dawes et al.
2010/0158387 A1 6/2010 Choi et al.
2010/0171807 A1 7/2010 Tysso
2010/0171808 A1 7/2010 Harrell et al.
2010/0183199 A1 7/2010 Smith et al.
2010/0199228 A1 8/2010 Latta et al.
2010/0201823 A1 8/2010 Zhang et al.
2010/0202285 A1 8/2010 Cohen et al.
2010/0205281 A1 8/2010 Porter et al.
2010/0205543 A1 8/2010 Von Werther et al.
2010/0208078 A1 8/2010 Tian et al.
2010/0241845 A1 9/2010 Alonso
2010/0259619 A1 10/2010 Nicholson
2010/0262367 A1 10/2010 Riggins et al.
2010/0268843 A1 10/2010 Van Wie et al.
2010/0277563 A1 11/2010 Gupta et al.
2010/0306703 A1 12/2010 Bourganel et al.
2010/0313148 A1 12/2010 Hochendoner et al.
2010/0316232 A1 12/2010 Acero et al.
2010/0325547 A1 12/2010 Keng et al.
2010/0329511 A1 12/2010 Yoon et al.
2011/0008017 A1 1/2011 Gausereide
2011/0029868 A1 2/2011 Moran et al.
2011/0032368 A1 2/2011 Pelling
2011/0039506 A1 2/2011 Lindahl et al.
2011/0063440 A1 3/2011 Neustaedter et al.
2011/0063467 A1 3/2011 Tanaka
2011/0082808 A1 4/2011 Beykpour et al.
2011/0085016 A1 4/2011 Kristiansen et al.
2011/0090303 A1 4/2011 Wu et al.
2011/0105220 A1 5/2011 Hill et al.
2011/0109642 A1 5/2011 Chang et al.
2011/0113348 A1 5/2011 Twiss et al.
2011/0164106 A1 7/2011 Kim
2011/0193982 A1 8/2011 Kook et al.
2011/0202878 A1 8/2011 Park et al.
2011/0225534 A1 9/2011 Wala
2011/0242266 A1 10/2011 Blackburn et al.
2011/0249081 A1 10/2011 Kay et al.
2011/0249086 A1 10/2011 Guo et al.
2011/0276901 A1 11/2011 Zambetti et al.
2011/0279627 A1 11/2011 Shyu
2011/0319885 A1 12/2011 Skwarek et al.
2012/0026278 A1 2/2012 Goodman et al.
2012/0038742 A1 2/2012 Robinson et al.

(56) References Cited

U.S. PATENT DOCUMENTS

| | | | |
|---|---|---|---|
| 2012/0106428 | A1 | 5/2012 | Schlicht et al. |
| 2012/0143605 | A1 | 6/2012 | Thorsen et al. |
| 2012/0169838 | A1 | 7/2012 | Sekine |
| 2012/0226997 | A1 | 9/2012 | Pang |
| 2012/0266082 | A1 | 10/2012 | Webber |
| 2012/0297342 | A1 | 11/2012 | Jang et al. |
| 2012/0327173 | A1 | 12/2012 | Couse et al. |
| 2013/0088565 | A1 | 4/2013 | Buckler |

FOREIGN PATENT DOCUMENTS

| | | | |
|---|---|---|---|
| CN | 102067593 | | 5/2011 |
| EP | 502600 | A2 | 9/1992 |
| EP | 0 650 299 | | 10/1994 |
| EP | 0 714 081 | | 11/1995 |
| EP | 0 740 177 | | 4/1996 |
| EP | 1143745 | A2 | 10/2001 |
| EP | 1 178 352 | A1 | 6/2002 |
| EP | 1 589 758 | A1 | 10/2005 |
| EP | 1701308 | A2 | 9/2006 |
| EP | 1768058 | A2 | 3/2007 |
| EP | 2073543 | A1 | 6/2009 |
| EP | 2255531 | | 12/2010 |
| EP | 2277308 | | 1/2011 |
| GB | 2 294 605 | A | 5/1996 |
| GB | 2336266 | | 10/1999 |
| GB | 2355876 | A | 5/2001 |
| WO | WO 94/16517 | | 7/1994 |
| WO | WO 96/21321 | | 7/1996 |
| WO | WO 97/08896 | | 3/1997 |
| WO | WO 98/47291 | | 10/1998 |
| WO | WO 99/59026 | | 11/1999 |
| WO | WO 01/33840 | | 5/2001 |
| WO | WO 2005/013001 | A2 | 2/2005 |
| WO | WO 2006/072755 | | 7/2006 |
| WO | WO2007/106157 | | 9/2007 |
| WO | WO2007/123946 | | 11/2007 |
| WO | WO 2007/123960 | A2 | 11/2007 |
| WO | WO 2007/123960 | A3 | 11/2007 |
| WO | WO2008/039371 | | 4/2008 |
| WO | WO 2008/040258 | | 4/2008 |
| WO | WO 2008/101117 | A1 | 8/2008 |
| WO | WO 2008/118887 | A2 | 10/2008 |
| WO | WO 2009/102503 | A2 | 8/2009 |
| WO | WO 2009/120814 | A2 | 10/2009 |
| WO | WO 2010/059481 | | 5/2010 |
| WO | WO2010/096342 | | 8/2010 |
| WO | WO 2010/104765 | | 9/2010 |
| WO | WO 2010/132271 | | 11/2010 |
| WO | WO2012/033716 | | 3/2012 |
| WO | WO2012/068008 | | 5/2012 |
| WO | WO2012/068010 | | 5/2012 |
| WO | WO2012/068485 | | 5/2012 |

OTHER PUBLICATIONS

Fiala, Mark, "Automatic Projector Calibration Using Self-Identifying Patterns," National Research Council of Canada; 6 pages http://www.procams.org/procams2005/papers/procams05-36.pdf.

U.S. Appl. No. 12/784,257, filed May 20, 2010, entitled "Implementing Selective Image Enhancement," Inventors: Dihong Tian et al.

U.S. Appl. No. 12/234,291, filed Sep. 19, 2008, entitled "System and Method for Enabling Communication Sessions in a Network Environment,", Inventor(s): Yifan Gao et al.

U.S. Appl. No. 12/366,593, filed Feb. 5, 2009, entitled "System and Method for Depth Perspective Image Rendering,", Inventor(s): J. William Mauchly et al.

U.S. Appl. No. 12/475,075, filed May 29, 2009, entitled "System and Method for Extending Communications Between Participants in a Conferencing Environment,", Inventor(s): Brian J. Baldino et al.

U.S. Appl. No. 12/400,540, filed Mar. 9, 2009, entitled "System and Method for Providing Three Dimensional Video Conferencing in a Network Environment,", Inventor(s): Karthik Dakshinamoorthy et al.

U.S. Appl. No. 12/400,582, filed Mar. 9, 2009, entitled "System and Method for Providing Three Dimensional Imaging in a Network Environment,", Inventor(s): Shmuel Shaffer et al.

U.S. Appl. No. 12/463,505, filed May 11, 2009, entitled "System and Method for Translating Communications Between Participants in a Conferencing Environment,", Inventor(s): Marthinus F. De Beer et al.

U.S. Appl. No. 12/727,089, filed Mar. 18, 2010, entitled "System and Method for Enhancing Video Images in a Conferencing Environment," Inventor: Joseph T. Friel.

"3D Particles Experiments in AS3 and Flash 053," printed Mar. 18, 2010, 2 pages; http://www.flashandmath.com/advanced/fourparticles/notes.html.

active8-3D—Holographic Projection—3D Hologram Retail Display & Video Project, [retrieved Feb. 24, 2009], http://www.activ8-3d.co.uk/3d_holocubes, 1 page.

Avrifhis, Y., et al., "Color-Based Retrieval of Facial Images," European Signal Processing Conference [EUSIPCO '00], Tampere, Finland; Sep. 2000; 18 pages.

Bakstein, Hynek, et al., "Visual Fidelity of Image Based Rendering," Center for Machine Perception, Czech Technical University, 10 pages.

Bücken R: "Bildfernsprechen: Videokonferenz vom Arbeitsplatz aus" Funkschau, Weka Fachzeitschriften Verlag, Poing, DE, No. 17, Aug. 14, 1986, pp. 41-43, XP002537729; ISSN: 0016-2841, p. 43, left-hand column, line 34—middle column, line 24; 3pgs.

Chen, Jason, "iBluetooth Lets iPhone Users Send and Receive Filed Over Bluetooth," Mar. 13, 2009; 1 page; http://i.gizmodo.com/5169545/ibluetooth-lets-iphone-users-send-and-receive-files-over-bluetooth.

Cisco: Bill Mauchly and Mod Marathe; UNC: Henry Fuchs, et al., "Depth-Dependent Perspective Rendering," 6 pgs.

Costa, Cristina, et al., "Quality Evaluation and Nonuniform Compression of Geometrically Distorted Images Using the Quadiree Distorion Map," EURASIP Journal on Applied Signal Processing, vol. 2004, No. 12; pp. 1899-1911; © 2004 Hindawi Publishing Corp; XP002536356; ISSN: 1110-8657; 16 pages.

Criminis, A., et al., "Efficient Dense-Stereo and Novel-view Synthesis for Gaze Manipulation in One-to-one Teleconferencing," Technical Rpt MSR-TR-2003-59, Sep. 2003 [retrieved Feb. 26, 2009], http://research.microsoft.com/pubs/67266/criminis_techrep2003-59.pdf, 41 pages.

Daly, S., et al., "Face-based visually-optimized image sequence coding," Image Processing, 1998, ICIP 98. Proceedings; 1998 International Conference on Chicago, IL; Oct. 4-7, 1998, Los Alamitos; IEEE Computing; vol. 3, Oct. 4, 1998; pp. 443-447, ISBN: 978-0-8186-8821-8; XP010586786, 5 pages.

Diaz, Jesus, iPhone Bluetooth File Transfer Coming Soon (Yes!); Jan. 25, 2009; 1 page; http://i.gizmodo.com/5138797/iphone-bluetooth-file-transfer-coming-soon-yes.

Diaz, Jesus, "Zcam 3D Camera is Like Wii Without Wiimote and Minority Report Without Gloves," Dec. 15, 2007, 3 pgs.; http://gizmodo.com/gadgets/zcam-depth-camera-could-be-wii-challenger/zcam-3d-camera-is-like-wii-without-wiimote-and-minority-report-without-gloves-334426.php.

DVE Digital Video Enterprises, "DVE Tele-Immersion Room," http://www.dvetelepresence.com/products/immersion_room.asp; 2009, 2 pgs.

"Dynamic Displays," copyright 2005-2008 [retrieved Feb. 24, 2009], http://www.zebraimaging.com/html/lighting_display.html, 2 pages.

ECmag.com, "IBS Products," Published Apr. 2009, 2 pages; http://www.ecmag.com/index.cfm?fa=article&articleID=10065.

Electrophysics Glossary, "Infrared Cameras, Thermal Imaging, Night Vision. Roof Moisture Detection," printed Mar. 18, 2010, 11 pages; http://www.electrophysics.com/Browse/Brw_Glossary.asp.

Farrukh, A., et al., Automated Segmentation of Skin-Tone Regions in Video Sequences, Proceedings IEEE Students Conference, ISCON_apos_02; Aug. 16-17, 2002; pp. 122-128; 7pgs.

Freeman, Professor Wilson T., Computer Vision Lecture Slides, "6.869 Advances in Computer Vision: Learning and Interfaces," Spring 2005; 21 pages.

Gemmell, Jim, et al., "Gaze Awareness for Video-conferencing: A Software Approach," IEEE Multimedia, Oct.-Dec. 2000; 10 pages.

(56) References Cited

OTHER PUBLICATIONS

Gotchev, Atanas, "Computer Technologies for 3D Video Delivery for Home Entertainment," International Conference on Computer Systems and Technologies; CompSysTech '08; 6 pgs; http://ecet.ecs.ru.acad.bg/cst08/docs/cp/Plenary/P.1.pdf.
Gries, Dan, "3D Particles Experiments in AS3 and Flash CS3, Dan's Comments," printed May 24, 2010, http://www.flashandmath.com/advanced/fourparticles/notes.html; 3pgs.
Guernsey, Lisa, "Toward Better Communication Across the Language Barrier," Jul. 29, 1999, http://www.nytimes.com/1999/07/29/technology/toward-better-communication-across-the-language-barrier.html; 2 pages.
Habili, Nariman, et al., "Segmentation of the Face and Hands in Sign Language Video Sequences Using Color and Motion Cues" IEEE Transaction on Circuits and Systems for Video Technology, IEEE Service Center, vol. 14, No. 8, Aug. 1, 2004; ISSN: 1051-8215; pp. 1086-1097; XP011115755; 13 pages.
Holographic Imaging, "Dynamic Holography for scientific uses, military heads up display and even someday HoloTV Using TI's DMD," [retrieved Feb. 26, 2009], http://innovation.swmed.edu/research/instrumentation/res_inst_dev3d.html, 5 pages.
Hornbeck, Larry J., "Digital Light Processing™: A New MEMS-Based Display Technology," [retrieved Feb. 26, 2009]; http://focus.ti.com/pdfs/dipdmd/17_Digital_Light_Processing_MEMS_display_techology.pdf, 22 pages.
"Infrared Cameras TVS-200-EX," printed May 24, 2010; 3 pgs; http://www.electrophysics.com/Browse/Brw_ProductLineCategory.asp?CategoryID=184&Area=IS.
IR Distribution Category @ Envious Technology, "IR Distribution Category," 2 pages http://www.envioustechnology.com.au/ products/product-list.php?CID=305, printed on Apr. 22, 2009.
IR Trans—Products and Orders—Ethernet Devices, 2 pages http://www.irtrans.de/en/shop/ian.php, printed on Apr. 22, 2009.
Isgro, Francesco et al., "Three-Dimensional Image Processing in the Future of Immersive Media," IEEE Transactions on Circuits and Systems for Video Technology, vol. 14, No. 3; XP011108796; ISSN: 1051-8215; Mar. 1, 2004; pp. 288-303; 16 pages.
Itoh, Hiroyasu, et al., "Use of a gain modulating framing camera for time-resolved imaging of cellular phenomena," SPIE vol. 2979, pp. 733-740; 8 pages.
Kauff, Peter, et al., "An Immersive 3D Video-Conferencing System Using Shared Virtual Team User Environments," Proceedings of the 4th International Conference on Collaborative Virtual Environments, XP040139458; Sep. 30, 2002; 8 pages.
Kazutake, Uehira, "Simulation of 3D image depth perception in a 3D display using two stereoscopic displays at different depths," http://adsabs.harvard.edu/abs/2006SPIE.6055.408U; 2006, 2 pgs.
Keijser, Jeroen, et al., "Exploring 3D Interaction in Alternate Control-Display Space Mappings," IEEE Symposium on 3D User interfaces, Mar. 10-11, 2007, pp. 17-24; 8 pages.
Klint, Josh, "Deferred Rendering in Leadwerks Engine," Copyright Leadwersk Corporation 2008, 10 pages; http://www.leadwerks.com/files/Deferred_Rendering_in_Leadwerks_Engine.pdf.
Koyama, S., et al. "A Day and Night Vision MOS Imager with Robust Photonic-Crystal-Based RGB-and-IR," Mar. 2008, pp. 754-759; ISSN: 0018-9383; IEE Transactions on Electron Devices, vol. 55, No. 3; 6 pages http://ieeexplore.ieee.org/stamp/stamp.jsp?tp=&arnumber=4455782&isnumber=4455723.
Lawson, S., "Cisco Plans TelePresence Translation Next Year," Dec. 9, 2008; http://www.pcworld.com/ article/155237/.html?ik=rss_news; 2 pages.
Miller, Gregor, et al., "Interactive Free-Viewpoint Video," Centre for Vision, Speech and Signal Processing, [retrieved Feb. 26, 2009], http://www.ee.surrey.ac.uk/CVSSP/VMRG/ Publications/miller05cvmppdf, 10 pages.
"Minoru from Novo is the worlds first consumer 3D Webcam," Dec. 11, 2008 [retrieved Feb. 24, 2009], http://www.minoru3d.com, 4 pages.
Mitsubishi Electric Research Laboratories, copyright 2009 [Retrieved Feb. 26, 2009], http://www.merl.com/projects/3dtv, 2 pages.
National Training Systems Association Home—Main, Interservice/Industry Training, Simulation & Education Conference, Dec. 1-4, 2008 [retrieved Feb. 26, 2009], http://ntsa.metapress.com/app/home/main.asp?referrer=default, 1 page.
OptoIQ, "Anti-Speckle Techniques Uses Dynamic Optics," Jun. 1, 2009, 2 pages; http://www.optolq.com/index/photonics-technologies-applications/lfw-display/lfw-article-display/363444/articles/optoiq2/photonics-technologies/technology-products/optical-components/optical-mems/2009/12/anti-speckle-technique-uses-dynamic-optics/QP129867/cmpid=EniOptoLFWJanuary32010.html.
OptoIQ, "Smart Camera Supports Multiple Interfaces," Jan. 22, 2009, 2 pages; http://www.optoiq.com/index/machine-vision-imaging-processing/display/vsd-article-display/350639/articles/vision-imaging-processing/display/vsd-article-display/350639/articles/vision-systems-design/daily-product-2/2009/01/smart-camera-supports-multiple-interfaces.html.
OptoIQ, "Vision + Automation Products—VideometerLab2,"; 11 pgs., http://www.optoiq.com/optoiq-2/en-us/index/machine-vision-imaging-processing/display/vsd-articles-tools-template.articles.vision-systems-design.volume-11.issue-10.departments.new-products.vision-automation-products.htmlhtml.
OptoIQ, "Vision Systems Design—Machine Vision and Image Processing Technology," printed Mar. 18, 2010, 2 pages; http://www.optoiq.com/index/machine-vision-imaging-processing.html.
PCT "Notification of Transmittal of the International Search Report and the Written Opinion of the International Searching Authority, or the Declaration," PCT/US2009/001070, dated Apr. 8, 2009, 17 pages.
PCT "Notification of Transmittal of the International Search Report and the Written Opinion of the International Searching Authority, or the Declaration," PCT/US2009/038310, dated Oct. 10, 2009, 19 pages.
Radhika, N., et al., "Mobile Dynamic reconfigurable Context aware middleware for Adhoc smart spaces," vol. 22, 2008, 3 pages http://www.acadjournal.com/2008/V22/part6/p7.
"Rayvel Business-to-Business Products," copyright 2004 [retrieved Feb. 24, 2009], http://www.rayvel.com/b2b.html, 2 pages.
"Robust Face Localisation Using Motion, Colour & Fusion" Dec. 10, 2003; Proc. VIIth Digital Image Computing: Techniques and Applications, Sun C. et al (Eds.), Sydney; 10 pgs.; Retrieved from the Internet: http://www.cmis.csiro.au/Hugues.Talbot/dicta2003/cdrom/pdf/0899.pdf; pp. 899-908, XP007905630.
School of Computing, "Bluetooth over IP for Mobile Phones," 1 page http://www.computing.dcu.ie/wwwadmin/fyp-abstract/list/fyp_details05.jsp?year=2005&number=51470574.
Sena, "Industrial Bluetooth," 1 page http://www.sena.com/products/industrial_bluetooth, printed on Apr. 22, 2009.
Shaffer, Shmuel, "Translation—State of the Art" presentation; Jan. 15, 2009; 22 pages.
Shi, C. et al., "Automatic Image Quality Improvement for Videoconferencing," IEEE ICASSP © 2004, 4 pgs.
Smarthome, "IR Extender Expands Your IR Capabilities," 3 pages http://www.smarthome.com/8121.html, printed Apr. 22, 2009.
Soohuan, Kim, et al., "Block-based face detection scheme using face color and motion estimation," Real-Time Imaging VIII; Jan. 20-22, 2004, San Jose, CA; vol. 5297, No. 1; Proceedings of the SPIE—The International Society for Optical Engineering SPIE-Int. Soc. Opt. Eng USA ISSN: 0277-786X; pp. 78-88; XP007905596; 11pgs.
"Super Home Inspectors or Super Inspectors," printed Mar. 18, 2010, 3 pages; http://www.umrt.com/PageManager/Default.aspx/PageID=2120325.
Total immersion, Video Gallery,copyright 2008-2009 [retrieved Feb. 26, 2009], http://www.t-immersion.com/en,video-gallery,36.html, 1 page.
Trucco, E., et al., "Real-Time Disparity Maps for Immersive 3-D Teleconferencing by Hybrid Recursive Matching and Census Transform," 9 pages; retrieved and printed from the website on May 4, 2010 from http://server.cs.ucf.edu/~vision/papers/VidReg-final.pdf.

(56) References Cited

OTHER PUBLICATIONS

Tsapatsoulis, N., et al., "Face Detection for Multimedia Applications," Proceedings of the ICIP '00; Vancouver, BC, Canada; Sep. 2000; 4 pages.
Tsapatsoulis, N., et al., "Face Detection in Color Images and Video Sequences," 10th Mediterranean Electrotechnical Conference (MELECON), 2000; vol. 2; pp. 498-502; 21 pgs.
Wang, Hualu, et al., "A Highly Efficient System for Automatic Face Region Detection inMPEG Video," IEEE Transactions on Circuits and Systems for Video Technology; vol. 7, Issue 4; 1977 pp. 615-628; 26 pgs.
Wilson, Mark, "Dreamoc 3D Display Turns Any Phone Into Hologram Machine," Oct. 30, 2008 [retrieved Feb. 24, 2009], http://gizmodo.com/5070906/dreamoc-3d-display-turns-any-phone-into-hologram-machine, 2 pages.
WirelessDevNet, Melody Launches Bluetooth Over IP, http://www.wirelessdevnet.com/news/2001/ 155/news5.html; 2 pages, printed on Jun. 5, 2001.
WO 2008/118887 A3 Publication with PCT International Search Report (4 pages), International Preliminary Report on Patentability (1 page), and Written Opinion of the ISA (7 pages); PCT/US2008/058079; dated Sep. 18, 2008.
Yang, Jie, et al., "A Real-Time Face Tracker," Proceedings 3rd IEEE Workshop on Applications of Computer Vision; 1996; Dec. 2-4, 1996; pp. 142-147; 6 pgs.
Yang, Ming-Hsuan, et al., "Detecting Faces in Images: A Survey," vol. 24, No. 1; Jan. 2002; pp. 34-58; 25 pgs.
Yang, Ruigang, et al., "Real-Time Consensus-Based Scene Reconstruction using Commodity Graphics Hardware," Department of Computer Science, University of North Carolina at Chapel Hill, 10 pgs.
Yoo, Byounghun, et al., "Image-Based Modeling of Urban Buildings Using Aerial Photographs and Digital Maps," Transactions in GIS, vol. 10 No. 3, p. 377-394, 2006; 18 pages [retrieved May 17, 2010], http://icad,kaist.ac.kr/publication/paper_data/image_based.pdf.
U.S. Appl. No. 12/781,722, filed May 17, 2010, entitled "System and Method for Providing Retracting Optics in a Video Conferencing Environment," Inventor(s): Joseph T. Friel, et al.
U.S. Appl. No. 12/877,833, filed Sep. 8, 2810, entitled "System and Method for Skip Coding During Video Conferencing in a Network Environment," Inventor[s]: Dihong Tian, et al.
U.S. Appl. No. 12/870,687, filed Aug. 27, 2010, entitled "System and Method for Producing a Performance Via Video Conferencing in a Network Environment," Inventor(s): Michael A. Arnao et al.
U.S. Appl. No. 12/912,556, filed Oct. 26, 2010, entitled "System and Method for Provisioning Flows in Mobile Network Environment," Inventors: Balaji Vankat Vankataswami, et al.
U.S. Appl. No. 12/949,614, filed Nov. 18, 2010, entitled "System and Method for Managing Optics in a Video Environment," Inventors: Torence Lu, et al.
U.S. Appl. No. 12/873,100, filed Aug. 31, 2010, entitled "System and Method for Providing Depth Adaptive Video Conferencing," Inventor(s): J. William Mauchly et al.
U.S. Appl. No. 12/946,679, filed Nov. 15, 2010, entitle "System and Method for Providing Camera Functions in a Video Environment," Inventors, Peter A.J. Fornell, et al.
U.S. Appl. No. 12/946,695, filed Nov. 15, 2010, entitied "System and Method for Providing Enhanced Audio in a Video Environment," Inventors: Wei Li, et al.
U.S. Appl. No. 12/907,914, filed Oct. 19, 2010, entitled "System and Method for Providing Videomail in a Network Environment," Inventors: David J. Mackie et al.
U.S. Appl. No. 12/950,786, filed Nov. 19, 2010, entitled "System and Method for Providing Enhanced Video Processing in a Network Environment," Inventor[s]: David J. Mackie.
U.S. Appl. No. 12/907,919, filed Oct. 19, 2010, entitled "System and Method for Providing Connectivity in a Network Environment," Inventors: David J. Mackie of al.
U.S. Appl. No. 12/946,704, filed Nov. 15, 2010, entitled "System and Method for Providing Enhanced Graphics in a Video Environment," Inventors: John M. Kanalakis et al.
U.S. Appl. No. 12/957,116, filed Nov. 30, 2010, entitled "System and Method for Gesture Interface Control," Inventors: Shuan K. Kirby, et al.
U.S. Appl. No. 13/036,925, filed Feb. 28, 2011 ,entitled "System and Method for Selection of Video Data in a Video Conference Environment," Inventor(s) Sylvia Olayinka Aya Manfa N'guessan.
U.S. Appl. No. 12/907,925, filed Oct. 19, 2010, entitled "System and Method for Providing a Pairing Mechanism in a Video Environment," Inventors: Gangfeng Kong, et al.
U.S. Appl. No. 12/939,037, filed Nov. 3, 2010, entitled "System and Method for Managing Flows in a Mobile Network Environment," Inventors: Balaji Venkat Venkataswami, et al.
U.S. Appl. No. 12/946,709, filed Nov. 15, 2010, entitled "System and Method for Providing Enhanced Graphics in a Video Environment," Inventors: John M. Kanalakis, Jr., et al.
U.S. Appl. No. 29/375,624, filed Sep. 24, 2010, entitled "Mounted Video Unit," Inventor(s): Ashok T. Desai et al.
U.S. Appl. No. 29/375,627, filed Sep. 24, 2010, entitled "Mounted Video Unit," Inventors: Ashok T. Desai et al.
U.S. Appl. No. 29/369,951, filed Sep. 15, 2010, entitled "Video Unit With Integrated Features," Inventor(s): Kyle A. Buzzard et al.
U.S. Appl. No. 29/375,458, filed Sep. 22, 2010, entitled "Video Unit With Integrated Features," Inventor(s): Kyle A. Buzzard et al.
U.S. Appl. No. 29/375,619, filed Sep. 24, 2010, entitled "Free-Standing Video Unit," Inventor(s): Ashok T. Desai et al.
U.S. Appl. No. 29/381,245, filed Dec. 16, 2010, entitled "Interface Element," Inventor(s): John M. Kanalakis, Jr., et al.
U.S. Appl. No. 29/381,250, filed Dec. 16, 2010, entitled "Interface Element," Inventor(s): John M. Kanalakis, Jr., et al.
U.S. Appl. No. 29/381,254, filed Dec. 16, 2010, entitled "Interface Element," Inventor(s): John M. Kanalakis, Jr., et al.
U.S. Appl. No. 29/381,256, filed Dec. 16, 2010, entitled "Interface Element," Inventor(s): John M. Kanalakis, Jr., et al.
U.S. Appl. No. 29/381,259, filed Dec. 16, 2010, entitled "Interface Element," Inventor(s): John M. Kanalakis, Jr., et al.
U.S. Appl. No. 29/381,260, filed Dec. 16, 2010, entitled "Interface Element," Inventor(s): John M. Kanalakis, Jr., et al.
U.S. Appl. No. 29/381,262, filed Dec. 16, 2010, entitled "Interface Element," Inventor(s): John M. Kanalakis, Jr., et al.
U.S. Appl. No. 29/381,264, filed Dec. 16, 2010, entitled "Interface Element," Inventor(s): John M. Kanalakis, Jr., et al.
Arrington, Michael, "eJamming—Distributed Jamming," TechCrunch; Mar. 16, 2006; http://www.techcrunch.com/2006/03/16/ejamming-distributed-jamming/; 1 page.
Beesley, S.T.C., et al., "Active Macroblock Skipping in the H.264 Video Coding Standard," in Proceedings of 2005 Conference on Visualization, Imaging, and Image Processing—VIIP 2005, Sep. 7-9, 2005, Benidorm, Spain, Paper 480-261, ACTA Press, ISBN: 0-88986-528-0; 5 pages.
Chan et al., "Experiments on Block-Malching Techniques for Video Coding," Multimedia Systems, vol. 2, 1994, pp. 228-241.
Chen et al., "Toward a Compelling Sensation of Telepresence: Demonstrating a Portal to a Distant (Static) Office," Proceedings Visualization 2000; VIS 2000; Salt Lake City, UT, Oct. 8-13, 2000; Annual IEEE Conference on Visualization, Los Alamitos, CA; IEEE Comp. Soc., US, Jan. 1, 2000, pp. 327-333; http://citeseerx.ist.psu.edu/viewdoc/summary?doi=10.1.1.35.1287.
"Cisco Expo Germany 2009 Opening," Posted on YouTube on May 4, 2009; http://www.youtube.com/watch?v=SDKsaSiz4MK; 2 pages.
eJamming Audio, Learn More; [retrieved and printed on May 27, 2010] http://www.ejamming.com/learnmore/; 4 pages.
Foote, J., et al., "Flycam: Practical Panoramic Video and Automatic Camera Control," in Proceedings of IEEE International Conference on Multimedia and Expo, vol. III, Jul. 30, 2000; pp. 1419-1422; http://citeseerx.ist.psu.edu/viewdoc/versions?doi=10.1.1.138.8686.
"France Telecom's Magic Telepresence Wall," Jul. 11, 2006; http://www.humanproductivitylab.com/archive_blogs/2006/07/11/france_telecoms_magic_telepres_1.php; 4 pages.
Guili, D., et al., "Orchestral: A Distributed Platform for Virtual Musical Groups and Music Distance Learning over the Internet in JavaTM

(56) References Cited

OTHER PUBLICATIONS

Technology"; [retrieved and printed on Jun. 6, 2010] http://ieeexplore.ieee.org/stamp/stamp.jsp?tp=&arnumber=778626; 2 pages.
He, L., et al., "The Virtual Cinematographer: A Paradigm for Automatic Real-Time Camera Control and Directing," Proc. SIGGRAPH, © 1996; http://research.microsoft.com/en-us/um/people/jhe/papers/siggraph96.vc.pdf; 8 pages.
Jiang, Minqiang, et al., "On Language Multiplier and Quantizer Adjustment for H.264 Frame-layer Video Rate Control," IEEE Transactions on Circuits and Systems for Video Technology, vol. 16, Issue 5, May 2006, pp. 663-669.
Kannangara, C.S., et al., "Complexity Reduction of H.264 Using Lagrange Multiplier Methods," IEEE Int. Conf. on Visual Information Engineering, Apr. 2005; www.rgu.ac.uk/files /h264_complexity_kannangara.pdf; 6 pages.
Kannangara, C.S., et al., "Low Complexity Skip Prediction for H.264 through Lagrangian Cost Estimation," IEEE Tranactions on Circuits and Systems for Video Technology, vol. 16, No. 2, Feb. 2006; www.rgu.ac.uk/files/h264_skippradicl_richardson_final.pdf; 20 pages.
Kim, Y.H., et al., "Adaptive mode decision for H.264 encoder," Electronics letters, vol. 40, issue 19, pp. 1172-1173, Sep. 2004; 2 pages.
Lee, J. and Jeon, B., "Fast Mode Decision for H.264," ISO/IEC MPEG and ITU-T VCEG Joint Video Team, Doc. JVT-J033, Dec. 2003; http://media.skku.ac.kr/publications/paper/intC/ljy_ICME2004.pdf; 4 pages.
Liu, Z., "Head-Size Equalization for Better Visual Perception of Video Conferencing," Proceedings, IEEEInternational Conference on Multimedia & Expo (ICME2005), Jul. 6-8, 2005, Amsterdam, The Netherlands; http://research.microsoft.com/users/cohen/HeadSizeEqualizationICME2005.pdf; 4 pages.
Mann, S., et al., "Virtual Bellows: Constructing High Quality Still from Video," Proceedings, First IEEE International Conference on Image Processing ICIP-94, Nov. 13-16, 1994, Austin, TX; http://citeseerx.ist.psu.edu/viewdoc/summary?doi=10.1.1.50.8405; 5 pages.
"Opera Over Cisco TelePresence at Cisco Expo 2009, in Hannover Germany—Apr. 28, 29," posted on YouTube on May 5, 2009; http://www.youtube.com/watch?v=N5jNH5E-38; 1 page.
Payatagool, Chris, "Orchestral Manoeuvres in the Light of Telepresence," Telepresence Options, Nov. 12, 2008; http://www.telepresenceoptions.com/2008/11/orchestral_manoeuvres; 2pages.
PCT "International Search Report and the Written Opinion of the International Searching Authority, or the Declaration," PCT/US2010/026456, dated Jun. 29, 2010, 11 pages.
PCT Search Report for PCT Application No. PCT/US2009/064061 dated Feb. 11, 2010, 4 pages.
PCT Written Opinion for PCT Application No. PCT/US2009/064061 dated Feb. 23, 2010; 14 pages.
Pixel Tools "Rate Control and H.264: H.264 rate control algorithm dynamically adjusts encoder parameters," [retrieved and printed on Jun. 10, 2010] http://www.pixeltools.om/rate_control_paper.html; 7 pages.
Richardson, I.E.G., et al., "Fast H.264 Skip Mode Selection Using and Estimation Framework," Picture Coding Symposium, (Beijing, China), Apr. 2006; www.rgu.ac.uk/files/richardson_fast_skip_estimation_pcs06.pdf; 6 pages.
Satoh, Kiyohide et al., "Passive Depth Acquisition for 3D Image Displays," IEICE Transactions on Information and Systems, Information Systems Society, Tokyo, JP, Sep. 1, 1994, vol. E77-D, No. 9, pp. 949-957.
Schroeder, Erica, "The Next Top Model—Collaboration," Collaboration, The Workspace: A New World of Communications and Collaboration, Mar. 9, 2009; http//blogs.cisco.com/collaboration/comments/the_next_top_model; 3 pages.
Shum, H.-Y, et al., "A Review of Image-Based Rendering Techniques," in SPIE Proceedings vol. 4067(3); Proceedings of the Conference on Visual Communications and Image Processing 2000, Jun. 20-23, 2000, Perth, Australia; pp. 2-13; https://research.microsoft.com/pubs/68826/review_image_rendering.pdf.
Sonoma Wireless Forums, "Jammin on Riflink," [retrieved and printed on May 27, 2010] http://www.sonomawireworks.com/forums/viewtopic.php?id=2659; 5 pages.
Sonoma Wireworks Rifflink, [retrieved and printed on Jun. 2, 2010] http://www.sonomawireworks.com/rifflink.php; 3 pages.
Sullivan, Gary J., et al., "Video Compression—From Concepts to the H.264/AVC Standard," Proceedings IEEE, vol. 93, No. 1, Jan. 2005; http://ip.hhi.de/imagecom_G1/assets/pdfs/pieee_sullivan_wiegand_2005.pdf; 14 pages.
Sun, X., et al., "Region of Interest Extraction and Virtual Camera Control Based on Panoramic Video Capturing," IEEE Trans. Multimedia, Oct. 27, 2003; http://vision.ece.ucsb.edu/publications/04mmXdsun.pdf; 14 pages.
Westerink, P.H., et al., "Two-pass MPEG-2 variable-bitrate encoding," IBM Journal of Research and Development, Jul. 1991, vol. 43, No. 4; http://citeseerx.ist.psu.edu/viewdoc/summary?doi=10.1.1.128.421; 18 pages.
Wiegand, T., et al., "Efficient mode selection for block-based motion compensated video coding," Proceedings, 2005 International Conference on Image Processing IIP 2005, pp. 2559-2562; citeseer.ist.psu.edu/wiegand95efficient.html.
Wiegand, T., et al., "Rate-distortion optimized mode selection for very low bit rate video coding and the emerging H.263 standard," IEEE Trans. Circuits Syst. Video Technol., Apr. 1996, vol. 6, No. 2, pp. 182-190.
Xin, Jun, et al., "Efficient macroblock coding-mode decision for H.264/AVC video coding," Technical Repot MERL 2004-079, Mitsubishi Electric Research Laboratories, Jan. 2004; www.merl.com/publications/TR2007-079/; 12 pages.
Yang, Xiaokang, et al., Rate Control for H.264 with Two-Step Quantization Parameter Determination but Single-Pass Encoding, EURASIP Journal on Applied Signal Processing, Jun. 2006; http://downloads.hindawi.com/journals/asp/2006/063409.pdf; 13 pages.
PCT Mar. 21, 2013 International Preliminary Report on Patentability from International Application Serial No. PCT/US2011/050380.
PRC Jan. 7, 2013 SIPO Second Office Action from Chinese Application Serial No. 200980105262.1.
PCT May 30, 2013 International Preliminary Report on Patentability and Written Opinion from the International Searching Authority for International Application Serial No. PCT/US2011/061442 8 pages.
PCT May 30, 2013 International Preliminary Report on Patentability and Written Opinion from the International Searching Authority for International Application Serial No. PCT/US2011/060579 6 pages.
PCT May 30, 2013 International Preliminary Report on Patentability and Written Opinion from the International Searching Authority for International Application Serial No. PCT/US2011/060584 7 pages.
PRC Apr. 3, 2013 SIPO Second Office Action from Chinese Application No. 200980119121.5; 16 pages.
PRC Jun. 18, 2013 Response to SIPO Second Office Action from Chinese Application No. 200980119121.5; 5 pages.
PRC Dec. 18, 2012 Response to SIPO First Office Action from Chinese Application No. 200980119121.5; 16 pages.
"Oblong Industries is the developer of the g-speak spatial operation environment," Oblong Industries Information Page, 2 pages, [Retrieved and printed on Dec. 1, 2010] http://oblong.com.
Underkoffler, John, "G-Speak Overview 1828121108," video clip, Vimeo.com, 1 page, [Retrieved and printed on Dec. 1, 2010] http://vimeo.com/2229299.
Kramer, Kwindla, "Mary Ann de Lares Norris at Thinking Digital," Oblong Industries, Inc. Web Log, Aug. 24, 2010; 1 page; http://oblong.com/articles/OBS6hEeJmoHoCwgJ.html.
"Mary Ann de Lares Norris," video clip, Thinking Digital 2010 Day Two, Thinking Digital Videos, May 27, 2010, 3 pages; http://videos.thinkingdigital.co.uk/2010/05/mary-ann-de-lares-norris-oblong/.
Kramer, Kwindla, "Oblong at TED," Oblong Industries, Inc. Web Log, Jun. 6, 2010, 1 page; http://oblong.com/article/OB22LFIS1NVyrOmR.html.
Video on TED.com, Pranav Mistry: the Thrilling Potential of SixthSense Technology (5 pages) and Interactive Transcript (5 pages), retrieved and printed on Nov. 30, 2010; http://www.ted.com/talks/pranav_mistry_the_thrilling_potential_of_sixthsense_technology.html.

(56) References Cited

OTHER PUBLICATIONS

"John Underkoffler points to the future of UI," video clip and interactive transcript, Video on TED.com, Jun. 2010, 6 pages; http://www.ted.com/talks/john_underkoffler_drive_3d_data_with_a_gesture.html.
Kramer, Kwindla, "Oblong on Bloomberg TV," Oblong Industries, Inc. Web Log, Jan. 28, 2010, 1 page; http://oblong.com/article/0AN_1KD9q990PEnw.html.
Kramer, Kwindla, "g-speak at RISD, Fall 2009," Oblong Industries, Inc. Web Log, Oct. 29, 2009, 1 page; http://oblong.com/article/09uW060q6xRIZYvm.html.
Kramer, Kwindla, "g-speak + TMG," Oblong Industries, Inc. Web Log, Mar. 24, 2009, 1 page; http://oblong.com/article/08mM77zpYMm7kFtv.html.
"G-stalt version 1," video clip, YouTube.com, posted by ziggles on Mar. 15, 2009, 1 page; http://youtube.com/watch?v=k8ZAql4mdvk.
Underkoffler, John, "Carlton Sparrell speaks at MIT," Oblong Industries, Inc. Web Log, Oct. 30, 2009, 1 page; http://oblong.com/article/09usAB411Ukb6CPw.html.
Underkoffler, John, "Carlton Sparrell at MIT Media Lab," video clip, Vimeo.com, 1 page, [Retrieved and printed Dec. 1, 2010] http://vimeo.com/7355992.
Underkoffler, John, "Oblong at Altitude: Sundance 2009," Oblong Industries, Inc. Web Log, Jan. 20, 2009, 1 page; http://oblong.com/article/08Sr62ron_2akg0D.html.
Underkoffler, John, "Oblong's tamper system 1801011309," video clip, Vimeo.com, 1 page, [Retrieved and printed Dec. 1, 2010] http://vimeo.com/2821182.
Feld, Brad, "Science Fact," Oblong Industries, Inc. Web Log, Nov. 13, 2008, 2 pages,http://oblong.com/article/084H-PKI5Tb914Ti.html.
Kwindla Kramer, "g-speak in slices," Oblong Industries, Inc. Web Log, Nov. 13, 2008, 6 pages; http://oblong.com/article/0866JqfNrFg1NeuK.html.
Underkoffler, John, "Origins: arriving here," Oblong Industries, Inc. Web Log, Nov. 13, 2008, 5 pages; http://oblong.com/article/085zBpRSY9JeLv2z.html.
Rishel, Christian, "Commercial overview: Platform and Products," Oblong Industries, Inc., Nov. 13, 2008, 3 pages; http://oblong.com/article/086E19gPvDcktAf9.html.
Chien et al., "Efficient moving Object Segmentation Algorithm Using Background Registration Technique," IEEE Transactions on Circuits and Systems for Video Technology, vol. 12, No. 7, Jul. 2002, 10 pages.
EPO Jul. 10, 2012 Response to EP Communication from European Application EP10723445.2.
EPO Sep. 24, 2012 Response to Mar. 20, 2012 EP Communication from European Application EP09725288.6.
Garg, Ashutosh, et al., "Audio-Visual ISpeaker Detection Using Dynamic Bayesian Networks," IEEE International Conference on Automatic Face and Gesture Recognition, 2000 Proceedings, 7 pages; http://www.ifp.illinois.edu/~ashutosh/papers/FG00.pdf.
Gussenhoven, Carlos, "Chapter 5 Transcription of Dutch Intonation," Nov. 9, 2003, 33 pages; http://www.ru.nl/publish/pages/516003/todisun-ah.pdf.
Gvili, Ronen et al., "Depth Keying," 3DV System Ltd., [Retrieved and printed on Dec. 5, 2011] 11 pages; http://research.microsoft.com/en-us/um/people/eyalofek/Depth%20Key/DepthKey.pdf.
Hock, Hans Henrich, "Prosody vs. Syntax: Prosodic rebracketing of final vocatives in English," 4 pages; [retrieved and printed on Mar. 3, 2011] http://speechprosody2010.illinois.edu/papers/100931.pdf.
Jong-Gook Ko et al., "Facial Feature Tracking and Head Orientation-Based Gaze Tracking," ITC-CSCC 2000, International Technical Conference on Circuits/Systems, Jul. 11-13, 2000, 4 pages; http://www.umiacs.umd.edu/~knkim/paper/itc-cscc-2000-jgko.pdf.
Lambert, "Polycom Video Communications," © 2004 Polycom, Inc., Jun. 20, 2004 http://www.polycom.com/global/documents/whitepapers/video_communications_h.239_people_content_polycom_patented_technology.pdf.
Liu, Shan, et al., "Bit-Depth Scalable Coding for High Dynamic Range Video," SPIE Conference on Visual Communications and Image Processing, Jan. 2008; 12 pages http://www.merl.com/papers/docs/TR2007-078.pdf.
Nakaya, Y., et al. "Motion Compensation Based on Spatial Transformations," IEEE Transactions on Circuits and Systems for Video Technology, Jun. 1994, Abstract Only http://ieeexplore.ieee.org/Xplore/login.jsp?url=http%3A%2F%2Fieeexplore.ieee.org%2Fiel5%2F76%2F7495%2F00305878.pdf%3Farnumber%3D305878&authDecision=-203.
Patterson, E.K., et al., "Moving-Talker, Speaker-Independent Feature Study and Baseline Results Using the CUAVE Multimodal Speech Corpus," EURASIP Journal on Applied Signal Processing, vol. 11, Oct. 2002, 15 pages http://www.clemson.edu/ces/speech/papers/CUAVE_Eurasip2002.pdf.
PRC Aug. 3, 2012 SIPO First Office Action from Chinese Application No. 200980119121.5; 16 pages.
Tan, Kar-Han, et al., "Appearance-Based Eye Gaze Estimation," in Proceedings IEEE WACV'02, 2002, 5 pages http://citeseer.ist.psu.edu/viewdoc/summary?doi=10.1.1.19.8921.
Trevor Darrell, "A Real-Time Virtual Mirror Display," 1 page, Sep. 9, 1998; http://people.csail.mit.edu/trevor/papers/1998-021/node6.html.
PRC Jul. 9, 2013 SIPO Third Office Action from Chinese Application No. 200980119121.5; 15 pages.
U.S. Appl. No. 14/055,427, filed Oct. 16, 2013, entitled "System and Method for Provisioning Flows in a Mobile Network Environment," Inventors: Balaji Vankat Vankataswami, et al.
PRC Aug. 28, 2013 SIPO First Office Action from Chinese Application No. 201080010988.X 7 pages.
PRC Nov. 26, 2013 SIPO First Office Action from Chinese Application No. 201080020670 5pgs.
PRC May 5, 2014 SIPO Second Office Action from Chinese Application No. 201080010988.x (English Translation Only).
PRC Nov. 15, 2014 SIPO Third Office Action from Chinese Application No. 201080010988.x.
PRC Sep. 3, 2014 SIPO First Office Action from Chinese Application No. 201180054805.
U.S. Appl. No. 14/154,608, filed Jan. 14, 2014, entitled "System and Method for Extending Communications Between Participants in a Conferencing Environment," Inventors: Brian Baldino, et al.
U.S. Appl. No. 13/096,772, filed Apr. 28, 2011, entitled "System and Method for Providing Enhanced Eye Gaze in a Video Conferencing Environment," Inventor(s) Charles C. Byers.
U.S. Appl. No. 13/106,002, filed May 12, 2011, entitled "System and Method for Video Coding in a Dynamic Environment," Inventors: Dihong Tian et al.
U.S. Appl. No. 13/098,430, filed Apr. 30, 2011, entitled "System and Method for Transferring Transparency Information in a Video Environment," Inventors: Eddie Collins et al.
U.S. Appl. No. 13/096,795, filed Apr. 28, 2011, entitled "System and Method for Providing Enhanced Eye Gaze in a Video Conferencing Environment," Inventors: Charles C. Byers.
U.S. Appl. No. 29/389,651, filed Apr. 14, 2011, entitled "Video Unit With Integrated Features," Inventor(s): Kyle A. Buzzard et al.
U.S. Appl. No. 29/389,654, filed Apr. 14, 2011, entitled "Video Unit With Integrated Features," Inventor(s): Kyle A. Buzzard et al.
"Real-time Hand Motion/Gesture Detection for HCI-Demo 2," video clip, YouTube, posted Dec. 17, 2008 by smmy0705, 1 page; www.youtube.com/watch?v=mLT4CFLII8A&feature=related.
"Custom 3D Depth Sensing Prototype System for Gesture Control," 3D Depth Sensing, GestureTek, 3 pages; [Retrieved and printed on Dec. 1, 2010] http://www.gesturetek.com/3ddepth/introduction.php.
3G, "World's First 3G Video Conference Service with New TV Commercial," Apr. 28, 2005, 4 pages; http://www.3g.co.uk/PR/April2005/1383.htm.
Andersson, L., et al., "LDP Specification," Network Working Group, RFC 3036, Jan. 2001, 133 pages; http://tools.ietf.org/html/rfc3036.
Awduche, D., et al., "Requirements for Traffic Engineering over MPLS," Network Working Group, RFC 2702, Sep. 1999, 30 pages; http://tools/ietf.org/pdf/rfc2702.pdf.

(56) References Cited

OTHER PUBLICATIONS

Berzin, O., et al., "Mobility Support Using MPLS and MP-BGP Signaling," Network Working Group, Apr. 28, 2008, 60 pages; http://www.potaroo.net/ietf/all-/draft-berzin-malis-mpls-mobility-01.txt.
Chen, Qing, et al., "Real-time Vision-base Hand Gesture Recognition Using Haar-like Features," Instrumentation and Measurement Technology Conference, Warsaw, Poland, May 1-3, 2007, 6 pages; http://www.google.com/url?sa=t&source=web&cd=1
&ved=0CB4QFjAA&url=http%3A%2F%2Fciteseerx.ist.psu.edu%2Fdownload%3Fdoi%3D10.1.1.93.
103%26rep%3Drep1%26type%3Dpdf
&ei=A28RTLKRDeftnQeXzZGRAw
&usg=AFQiCNHpwj5MwjgGp-3goVzSWad6CO-Jzw.
Digital Video Enterprises, "DVE Eye Contact Silhouette," 1 page, © DVE 2008; http://www.dvetelepresence.com/products/eyeContactSilhouette.asp.
Dornaika F., et al., "Head and Facial Animation Tracking Using Appearance-Adaptive Models and Particle Filtes," 20040627; 20040627-20040602, Jun. 27, 2004, 22 pages; HEUDIASY Reseach Lab, http://eprints.pascal-network.org/archive/00001231/01/rtvhci_chapter8.pdf.
EPO Aug. 15, 2011 Response to EPO Communication mailed Feb. 25, 2011 from European Patent Application No. 09725288.6; 15 pages.
EPO Communication dated Feb. 25, 2011 for EP09725288.6 (published as EP22777308); 4 pages.
Geys et al., "Fast Interpolated Cameras by Combining a GPU Based Plane Sweep With a Max-Flow Regularisation Algorithm," Sep. 9, 2004; 3D Data Processing, Visualization and Transmission 2004, pp. 534-541.
Gluckman, Joshua, et al., "Rectified Catadioptric Stereo Sensors," 8 pages, retrieved and printed on Sep. 17, 2010; http://cis.poly.edu/~gluckman/papers/cvpr00.pdf.
Gundavelli, S., et al., "Proxy Mobile IPv6," Network Working Group, RFC 5213, Aug. 2008, 93 pages; http://tools/ietf.org/pdf/rfc5213.pdf.
Hammadi, Nait Charif et al., "Tracking the Activity of Participants in a Meeting," Machine Vision and Applications, Springer, Berlin, De Lnkd—DOI:10.1007/S00138-006-0015-5, vol. 17, No. 2, May 1, 2006, pp. 83-93, XP019323925 http://citeseerx.ist.psu.edu/viewdoc/summary?doi=10.1.1.106.9832.
Hepper, D., "Efficiency Analysis and Application of Uncovered Background Prediction in a Low BitRate Image Coder," IEEE Transactions on Communications, vol. 38, No. 9, pp. 1578-1584, Sep. 1990.
Jamoussi, Bamil, "Constraint-Based LSP Setup Using LDP," MPLS Working Group, Sep. 1999, 34 pages; http://tools.ietf.org/html/draft-ietf-mpls-cr-ldp-03.
Jeyatharan, M., et al., "3GPP TFT Reference for Flow Binding," MEXT Working Group, Mar. 2, 2010, 11 pages; http://www.ietf.org/id/draft-jeyatharan-mext-flow-tftemp-reference-00.txt.
Kollarits, R.V., et al., "34.3: An Eye Contact Camera/Display System for Videophone Applications Using a Conventional Direct-View LCD," © 1995 SID, ISSN0097-0966X/95/2601, pp. 765-768; http://citeseerx.ist.psu.edu/viewdoc/
download;jsessionid=47A1E7E028C26503975E633
895D114EC?doi=10.1.1.42.1772&rep=rep1&type=pdf.
Kolsch, Mathias, "Vision Based Hand Gesture Interfaces for Wearable Computing and Virtual Environments," A Dissertation submitted in partial satisfaction of the requirements for the degree of Doctor of Philosophy in Computer Science, University of California, Santa Barbara, Nov. 2004, 288 pages http://fulfillment.umi.com/dissertations/b7afbcb56ba72fdb14d26dfccc6b470f/1291487062/3143800.pdf.
Kwalek, B., "Model Based Facial Pose Tracking Using a Particle Filter," Geometric Modeling and Imaging—New Trends, 2006 London, England Jul. 5-6, 2005, Piscataway, NJ, USA, IEEE LNKD-DOI: 10.1109/GMAI.2006.34 Jul. 5, 2006, pp. 203-208; XP010927285 [Abstract Only].
Marvin Imaging Processing Framework, "Skin-colored pixels detection using Marvin Framework," video clip, YouTube, posted Feb. 9, 2010 by marvinproject, 1 page; http://www.youtube.com/user/marvinproject#p/a/u/0/3ZuQHYNlcrl.
Miller, Paul, "Microsoft Research patents controller-free computer input via EMG muscle sensors," Engadget.com, Jan. 3, 2010, 1 page; http://www.engadget.com/2010/01/03/microsoft-research-patents-controller-free-computer-input-via-em/.
Oh, Hwang-Seok, et al., "Block-Matching Algorithm Based on Dynamic Search Window Adjustment," Dept. of CS, KAIST, 1997, 6 pages; http://citeseerx.ist.psu.edu/viewdoc/similar?doi=10.1.1.29.8621&type=ab.
PCT Sep. 25, 2007 Notification of Transmittal of the International Search Report from PCT/US06/45895.
PCT Sep. 2, 2008 International Preliminary Report on Patentability (1 page) and the Written Opinion of th ISA (4 pages) from PCT/US2006/045895.
PCT Sep. 2, 2008 Notification of Transmittal of the International Search Report from PCT/US07/09469.
PCT Nov. 4, 2008 International Preliminary Report on Patentability (1 page) and the Written Opinion of the ISA (8 pages) from PCT/US2007/009469.
PCT May 11, 2010, International Search Report from PCT/US2010/024059; 4 pages.
PCT Aug. 26, 2010 International Preliminary Report on Patentability mailed Aug. 26, 2010 for PCT/US2009/001070; 10 pages.
PCT Aug. 23, 2011 International Preliminary Report on Patentability and Written Opinion of the ISA from PCT/US2010/024059; 6 pages.
PCT Oct. 7, 2010 International Preliminary Report on Patentability mailed Oct. 7, 2010 for PCT/US2009/038310; 10 pages.
PCT May 15, 2006 International Report of Patentability dated May 15, 2006, for PCT International Application PCT/US2004/021585, 6 pages.
PCT Aug. 24, 2010 International Search Report mailed Aug. 24, 2010 for PCT/US2010033880; 4 pages.
Richardson, Iain, et al., "Video Encoder Complexity Reduction by Estimating Skip Mode Distortion," Image Communication Technology Group; [Retrieved and printed Oct. 21, 2010] 4 pages; http://www4.rgu.ac.uk/files/ICIP04_richardson_zhao_final.pdf.
U.S. Appl. No. 13/298,022, filed Nov. 16, 2011, entitled "System and Method for Alerting a Participant in a Video Conference," Inventor(s): TiongHu Lian, et al.
PCT Sep. 13, 2011 International Preliminary Report on Patentability and the Written Opinion of the ISA from PCT/US2010/026456; 5 pages.
PCT Oct. 12, 2011 International Search Report and Written Opinion of the ISA from PCT/US2011/050380.
PCT Nov. 24, 2011 International Preliminary Report on Patentability from International Application Serial No. PCT/US2010/033880; 6 pages.
EPO Nov. 3, 2011 Communication from European Application EP10710949.8; 2 pages.
EPO Mar. 12, 2012 Response to EP Communication dated Nov. 3, 2011 from European Application EP10710949.8; 15 pages.
EPO Mar. 20, 2012 Communication from European Application 09725288.6; 6 pages.
PCT Jan. 23, 2012 International Search Report and Written Opinion of the ISA from International Application Serial No. PCT/US2011/060579; 10 pages.
PCT Jan. 23, 2012 International Search Report and Written Opinion of the ISA from International Application Serial No. PCT/US2011/060584; 11 pages.
PCT Feb. 20, 2012 International Search Report and Written Opinion of the ISA from International Application Serial No. PCT/US2011/061442; 12 pages.
Perez, Patrick, et al., "Data Fusion for Visual Tracking with Particles," Proceedings of the IEEE, vol. XX, No. XX, Feb. 2004, 18 pages http://citeseer.ist.psu.edu/viewdoc/summary?doi=10.1.1.6.2480.
"Potamianos, G., et a., "An Image Transform Approach for HMM Based Automatic Lipreading," in Proceedings of IEEE ICIP, vol. 3, 1998, 5 pages http://citeseerx.ist.psu.edu/viewdoc/summary?doi=10.1.1.13.6802".

(56) References Cited

OTHER PUBLICATIONS

"Rikert, T.D., et al., "Gaze Estimation using Morphable models," IEEE International Conference on Automatic Face and Gesture Recognition, Apr. 1998; 7 pgs. http://citeseer.ist.psu.edu/viewdoc/summary?doi=10.1.1.30.9472".
Soliman, H., et al., "Flow Bindings in Mobile IPv6 and NEMO Basic Support," IETF MEXT Working Group, Nov. 9, 2009, 38 pages; http://tools.ietf.org/html/draft-ietf-mext-flow-binding-04.
Sudan, Ranjeet, "Signaling in MPLS Networks with RSVP-TE-Technology Information," Telecommunications, Nov. 2000, 3 pages; http://findarticles.com/p/articles/mi_mOTLC/is_11_34/ai_67447072/.
"Eye Tracking," from Wikipedia, (printed on Aug. 31, 2011) 12 pages; http://en.wikipedia.org/wiki/Eye_tracker.
"RoundTable, 360 Degrees Video Conferencing Camera unveiled by Microsoft," TechShout, Jun. 30, 2006, 1 page; http://www.techshout.com/gadgets/2006/30/roundtable-360-degrees-video-conferencing-camera-unveiled-by-microsoft/#.
"Vocative Case," from Wikipedia, [retrieved and printed on Mar. 3, 2011] 11 pages; http://en.wikipedia.org/wiki/Vocative_case.
""Eye Gaze Response Interface Computer Aid (Erica) tracks Eye movement to enable hands-free computer operation," UMD Communication Sciences and Disorders Tests New Technology, University of Minnesota Duluth, posted Jan. 19, 2005; 4 pages http://www.d.umn.edu/unirel/homepage/05/eyegaze.html".
"Simple Hand Gesture Recognition," video clip, YouTube, posted Aug. 25, 2008 by pooh8210, 1 page; http://www.youtube.com/watch?v=F8GVeVOdYLM&feature=related.
"Andreopoulos, Yiannis, et al., "In-Band Motion Compensated Temporal Filtering,"" Signal Processing: Image Communication 19 (2004) 653-673, 21 pages http://medianetlab.ee.ucla.edu/papers/011.pdf.
"Arulampalam, M. Sanjeev, et al., "A Tutorial on Particle Filters for Online Nonlinear/Non-Gaussian Bayesian Tracking," IEEE Transactions on Signal Processing, vol. 50, No. 2, Feb. 2002, 15 pages http://www.cs.ubc.ca/~murphyk/Software/Kalman/ParticleFilterTutorial.pdf".
Boros, S., "Policy-Based Network Management with SNMP," Proceedings of the EUNICE 2000 Summer School Sep. 13-15, 2000, p. 3.
Cumming, Jonathan, "Session Border Control in IMS, An Analysis of the Requirements for Session Border Control in IMS Networks," Sections 1.1, 1.1.1, 1.1.3, 1.1.4, 2.1.1, 3.2, 3.3.1, 5.2.3 and pp. 7-8, Data Connection, 2005.
"Eisert, Peter, "Immersive 3-D Video Conferencing: Challenges, Concepts and Implementations," Proceedings of SPIE Visual Communications and Image Processing (VCIP), Lugano, Switzerland, Jul. 2003; 11 pages; http://iphome.hhi.de/eisert/papers/vcip03.pdf".
Veratech Corp., "Phantom Sentinel," © VeratechAero 2006, 1 page; http://www.veratechcorp.com/phantom.html.
Vertegaal, Roel, et al., "GAZE-2: Conveying Eye Contact in Group Video Conferencing Using Eye-Controlled Camera Direction," CHI 2003, Apr. 5-10, 2003, Fort Lauderdale, FL; Copyright 2003 ACM 1-58113-630-7/03/0004; 8 pages; http://www.hml.queensu.ca/papers/vertegaalchi0403.pdf.
Wachs, J., et al., "A Real-time Hand Gesture System Based on Evolutionary Search," Vision, 3rd Quarter 2006, vol. 22, No. 3, 18 pages; http://web.ics.purdue.edu/~jpwachs/papers/3q06vi.pdf.
Wang, Robert and Jovan Popovic, "Bimanual rotation and scaling," video clip, YouTube, posted by rkeltset on Apr. 14, 2010, 1 page; http://www.youtube.com/watch?v=7TPFSCX79U.
Wang, Robert and Jovan Popovic, "Desktop virtual reality," video clip, YouTube, posted by rkeltset on Apr. 8, 2010, 1 page; http://www.youtube.com/watch?v=9rBtm62Lkfk.
Wang, Robert and Jovan Popovic, "Gestural user input," video clip, YouTube, posted by rkeltset on May 19, 2010, 1 page; http://www.youtube.com/watch?v=3JWYTtBjdTE.
Wang, Robert and Jovan Popovic, "Manipulating a virtual yoke," video clip, YouTube, posted by rkeltset on Jun. 8, 2010, 1 page; http://www.youtube.conn/watch?v=UfgGOO2uM.
Wang, Robert and Jovan Popovic, "Real-Time Hand-Tracking with a Color Glove, ACM Transaction on Graphics," 4 pages, [Retrieved and printed on Dec. 1, 2010] http://people.csail.mit.edu/rywang/hand.
Wang, Robert and Jovan Popovic, "Real-Time Hand-Tracking with a Color Glove, ACM Transaction on Graphics" (SIGGRAPH 2009), 28(3), Aug. 2009; 8 pages http://people.csail.mit.edu/rywang/handtracking/s09-hand-tracking.pdf.
Wang, Robert and Jovan Popovic, "Tracking the 3D pose and configuration of the hand," video clip, YouTube, posted by rkeltset on Mar. 31, 2010, 1 page; http://www.youtube.com/watch?v=JOXwJkWP6Sw.
Weinstein et al., "Emerging Technologies for Teleconferencing and Telepresence," Wainhouse Research 2005 http://www.ivci.com/pdf/whitepaper-emerging-technologies-for-teleconferencing-and-telepresence.pdf.
"Wi-Fi Protected Setup,""from Wikipedia, Sep. 2, 2010, 3 pages http://en.wikipedia.org/wiki/Wi-Fi_Protected_Setup".
Xia, F., et al., "Home Agent Initiated Flow Binding for Mobile IPv6," Network Working Group, Oct. 19, 2009, 15 pages; http://tools.ietf.orghtml/draft-xia-mext-ha-init-flow-binding-01.txt.
Yegani, P. et al., "GRE Key Extension for Mobile IPv4," Network Working Group, Feb. 2006, 11 pages; http://tools.ietf.org/pdf/draft-yegani-gre-key-extension-01.pdf.
"Zhong, Ren, et al., "Integration of Mobile IP and MPLS," Network Working Group, Jul. 2000, 15 pages; http://tools.ietf.org/html/draft-zhong-mobile-ip-mpls-01".

* cited by examiner

SYSTEM AND METHOD FOR VERIFYING PARAMETERS IN AN AUDIOVISUAL ENVIRONMENT

TECHNICAL FIELD

This disclosure relates in general to the field of audiovisual systems and, more particularly, to verifying parameters in an audiovisual environment.

BACKGROUND

Audiovisual systems have become increasingly important in today's society. In certain architectures, universal remote controls have been developed to control or to adjust electronic devices. The remote controls can change various parameters in providing compatible settings amongst devices. In some cases, the remote control can turn on devices and, subsequently, switch input sources to find a correct video input to display. Some issues have arisen in these scenarios because of a lack of feedback mechanisms, which could assist in these processes. Furthermore, many of the remote controls are difficult to manipulate, where end users are often confused as to what is being asked of them.

BRIEF DESCRIPTION OF THE DRAWINGS

To provide a more complete understanding of the present disclosure and features and advantages thereof, reference is made to the following description, taken in conjunction with the accompanying figures, where like reference numerals represent like parts, in which.

DETAILED DESCRIPTION OF EXAMPLE EMBODIMENTS

Overview

A method is provided in one example embodiment and includes communicating a code to initiate cycling through a plurality of potential audiovisual inputs. The method includes receiving image data that is rendered on a display, the image data being based on a first one of the audiovisual inputs. The method also includes comparing the image data of the first one of the audiovisual inputs to a stored test pattern image associated with a selected audiovisual application to verify if the image data matches the stored test pattern for the selected audiovisual application. In more specific embodiments, the cycling through of the plurality of potential audiovisual inputs is terminated if the image data matches the stored test pattern for the selected audiovisual application. The code represents one or more infrared audiovisual commands being repeatedly sent to the display. The commands are sent until the stored test pattern image is detected on the display.

Example Embodiments

Figure 1:
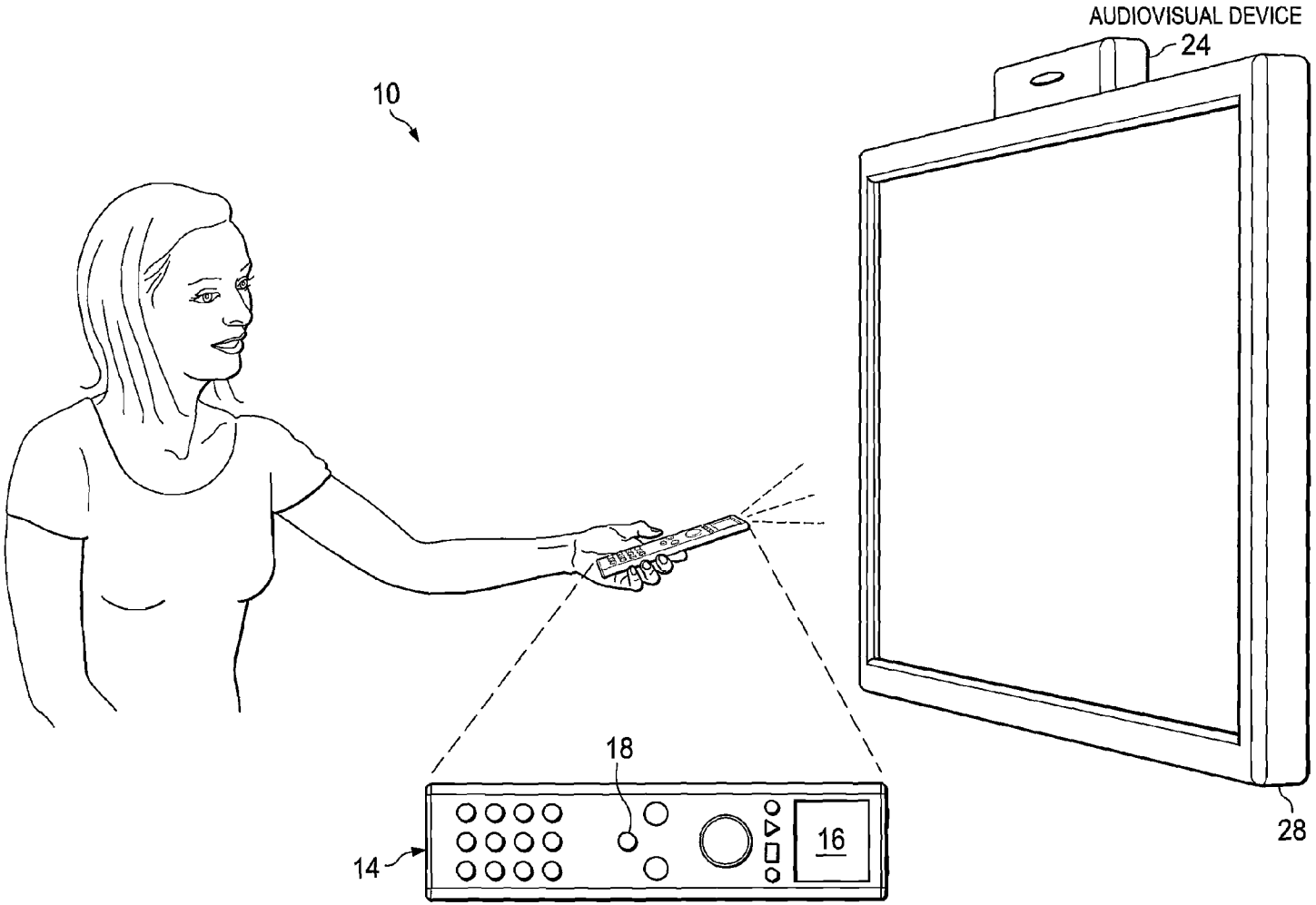
FIG. 1 is a simplified block diagram of a system for adjusting and verifying parameters in an audiovisual (AV) system in accordance with one example embodiment.

Turning to FIG. 1 is a simplified block diagram of a system 10 for adjusting and verifying parameters in an audiovisual (AV) system in accordance with one example embodiment. System 10 may include a remote control 14, which may include a camera 16 and a dedicated button 18. System 10 also includes an audiovisual device 24, which is configured to interface with a display 28. Both display 28 and audiovisual device 24 are capable of receiving and interpreting various codes being sent by remote control 14. Alternatively, audiovisual device 24 may be provided within display 28, or suitably embedded therein, such that it can receive signals from remote control 14 and render data to display 28 (e.g., via a video input such that display 28 renders images and/or provides audio through one or more speakers).

Before detailing the infrastructure of FIG. 1, some contextual information is provided. Such information is offered earnestly and for teaching purposes only and, therefore, should not be construed in any way that would limit broad applications for the present disclosure. A problem exists in complex AV systems and, to better accommodate these architectures, a host of universal remote control solutions have been provided to simplify AV operations. The objective in many of these environments is simply to perform some activity, such as watching a DVD movie, playing a videogame, or toggling between video inputs. Certain macros (which are sequences of instructions for performing some task) can be employed to address some of these issues. The macros can be sent using infrared, and they can dictate how corresponding devices are to behave. There are several problems associated with such a solution. For example, a macro does not understand the current state of the electronic device. For instance, a macro would not understand if the AV system were currently ON or OFF. Additionally, there is an open loop problem in these environments, meaning: a person (such as the end user of FIG. 1) does not know if the commands being sent will perform the requested actions. In essence, there is no feedback mechanism present to ensure that an activity has been completed.

A second layer associated with this dilemma deals with a particular end user group who encounters these technical difficulties. One group that is technologically savvy may simply cycle through various inputs (and waste time) in arriving at the appropriate AV source for the particular application sought to be used. For a different group of end users who are not technologically inclined, the AV input selection issue presents an insurmountable problem. Note that the evolution of AV systems into more sophisticated architectures has made this difficulty more prominent. Selecting between various AV sources is incomprehensible to many end users, who simply do not understand what is being asked of them. In many instances, the end user is relegated the task of turning on multiple devices, configuring each device to be on the proper channel, and then coordinating between devices in order to render the appropriate images on display 28.

Example embodiments presented herein can potentially address these issues in several ways. First, remote control 14 can employ the use of camera 16, which gathers information about what an end user would see on display 28. The end user is no longer burdened with trying to identify if the wrong input has been configured and, subsequently, correct the problem himself. Essentially, the system has substitutes for troubleshooting, which would otherwise require the involvement of the end user. In one example implementation, a universal remote control is fitted with an inexpensive camera, which can automate television adjustments to control a display, which may receive input from a selected audiovisual source. Such an architecture would stand in contrast to other remote controls that are incapable of automatically verifying that a requested change in AV mode has, in fact, been completed.

Secondly, the architecture can connect an infrared control decision tree to an image classifier in a feedback loop in order to automate a correct configuration of an audiovisual (or audio video) equipment stack. The intelligent stack would not be the only use of camera 16. For example, the camera could have a possible secondary use as part of a data input or pointing device. Furthermore, remote control 14 can be used for "auto" remote code programming. For example, remote control 14 can cycle through codes and recognize which code affected the television (e.g., turned it off). Note that before turning to some of the additional operations of this architecture and associated examples, a brief discussion is provided about the infrastructure of FIG. 1.

Remote control 14 is an electronic device used for the remote operation of a machine. As used herein in this Specification, the term 'remote control' is meant to encompass any type of electronic controller, clicker, flipper, changer, or any other suitable device, appliance, component, element, or object operable to exchange, transmit, or process information in a video environment. This is inclusive of personal computer (PC) applications in which a computer is actively involved in changing one or more parameters associated with a given data stream. In operation, remote control 14 issues commands from a distance to displays (and other electronics). Remote control 14 can include an array of buttons for adjusting various settings through various pathways (e.g. infrared (IR) signals, radio signals, Bluetooth, 802.11, etc.).

As illustrated in FIG. 1, display 28 offers a screen at which video data can be rendered for the end user. Note that as used herein in this Specification, the term 'display' is meant to connote any element that is capable of rendering an image and/or delivering sound for an end user. This would necessarily be inclusive of any panel, plasma element, television, monitor, computer interface, screen, or any other suitable element that is capable of delivering such information. Note also that the term 'audiovisual' is meant to connote any type of audio or video (or audio-video) data applications (provided in any protocol or format) that could operate in conjunction with remote control 14.

Audiovisual device 24 could be a set top box, a digital video recorder (DVR), a videogame console, a videocassette recorder (VCR), a digital video disc (DVD) player, a digital video recorder (DVR), a proprietary box (such as those provided in hotel environments), a TelePresence device, an AV switchbox, an AV receiver, or any other suitable device or element that can receive and process information being sent by remote control 14 and/or display 28. Each audiovisual device 24 can be associated with an audiovisual application (e.g., playing a DVD movie, playing a videogame, conducting a TelePresence session, etc.). Similarly, each audiovisual device 24 can be associated with a specific audiovisual input. Alternatively, a single audiovisual device 24 can include multiple audiovisual applications in a single set-top box and, similarly, account for multiple audiovisual inputs.

Audiovisual device 24 may interface with display 28 through a wireless connection, or via one or more cables or wires that allow for the propagation of signals between these two elements. Audiovisual device 24 and display 28 can receive signals from remote control 14 and the signals may leverage infrared, Bluetooth, WiFi, electromagnetic waves generally, or any other suitable transmission protocol for communicating data from one element to another. Virtually any control path can be leveraged in order to deliver information between remote control 14 and display 28. Transmissions between these two devices are bidirectional in certain embodiments such that the devices can interact with each other. This would allow the devices to acknowledge transmissions from each other and offer feedback where appropriate.

Remote control 14 may be provided within the physical box that is sold to a buyer of an associated audiovisual device 24. An appropriate test pattern may be programmed in remote control 14 in such an instance in order to carry out the operations outlined herein. Alternatively, remote control 14 can be provided separately, such that it can operate in conjunction with various different types of devices. In other scenarios, remote control 14 may be sold in conjunction with a dedicated AV switchbox or AV receiver, which could be configured with multiple test patterns corresponding to each of its possible inputs. Such a switchbox could provide feedback to remote control 14 regarding which input it has determined is being displayed.

In one example implementation, remote control 14 is preprogrammed with a multitude of test patterns, which can be used to verify the appropriate AV source is being used. In other scenarios, an application program interface (API) could be provided to third parties in order to integrate remote control 14 into their system's operations. Other example implementations include downloading new or different test patterns in order to perform the verification activities discussed herein. Test patterns could simply be registered at various locations, or on websites, such that remote control 14 could receive systematic updates about new test patterns applicable to systems being used by their respective end users. Further, some of this information could be standardized such that patterns on display 28 could be provided at specific areas (e.g., via a small block in the upper left-hand corner of display 28, or in the center of display 28, etc.).

Figure 2:
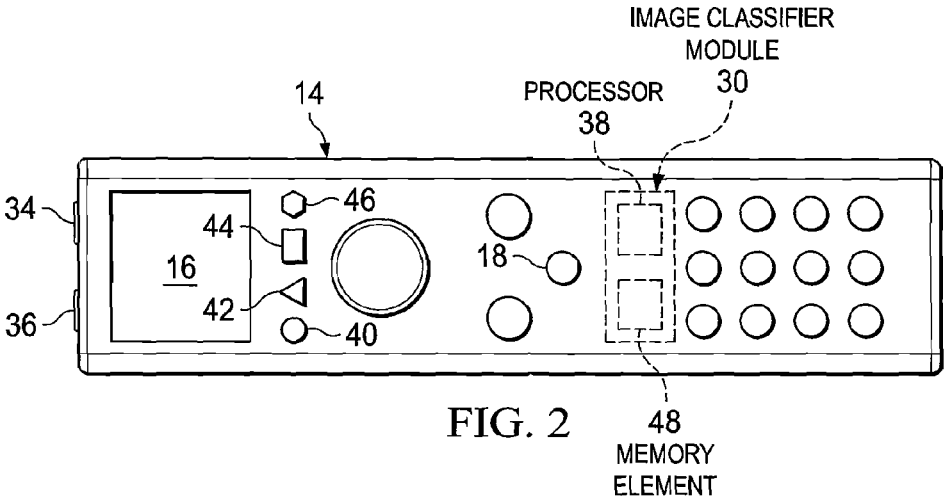
FIG. 2 is a simplified schematic diagram illustrating possible components of a remote control in accordance with one example embodiment.

FIG. 2 is a simplified schematic diagram of remote control 14, which further details potential features to be included therein. In one example implementation, remote control 14 includes an image classifier module 30. Image classifier module 30 may include (and/or interface with) a processor 38 and a memory element 48. Image classifier module 30 can include an automation algorithm that includes two components in one example implementation. One component identifies the theorized state of audiovisual device 24 based on data being imaged by camera 16. A second component allows new commands to be sent by remote control 14 in order to change the state of audiovisual device 24.

Figure 3:
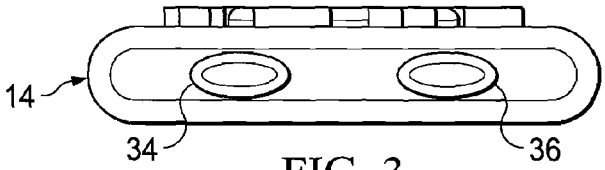
FIG. 3 is a simplified schematic diagram of a top view of the remote control in accordance with one example embodiment.

Remote control 14 also includes a camera optics element 34 and an infrared emitter 36 (and this is further shown in FIG. 3, which offers a top view of remote control 14). In one example, camera optics element 34 includes a fisheye lens in order to improve the field of view (offering a wide view) and reliability of the image detection. In using a wide view type of lens, inaccuracies in pointing remote control 14 haphazardly are accommodated. Alternatively, camera optics element 34 may include any suitable lens to be used in detecting a testing pattern (i.e., an image). In one example implementation, camera optics element 34 and infrared emitter 36 are provided in a parallel configuration in order to further engender feedback being provided by display 28. For example, feedback from audiovisual device 24 can be provided based on IR codes being sent by infrared emitter 36. Thus, the feedback being received by camera optics element 34 is corresponding to an appropriate aiming of infrared emitter 36 to deliver the appropriate IR codes.

In one example, remote control 14 further includes a number of dedicated buttons 40, 42, 44, and 46, which can expedite a series of activities associated with displaying information on display 28. These buttons may be provided in conjunction with dedicated button 18, or be provided as an alternative to button 18 in that this series of buttons can offer application specific operations, which can be performed for each associated technology.

For example, button 40 may be configured to perform a series of tasks associated with playing a DVD movie. Button 40 may simply be labeled "DVD Play", where an end user could press button 40 to initiate a series of instructions associated with delivering the end user to the appropriate application for playing DVD movies. The user in this instance was initially watching television and by pressing button 40, the DVD player could be powered on, and the proper video source could be selected for rendering the appropriate AV information on display 28. There could be a subsequent step involved in this set of instructions, in which the movie could be played from its beginning, or at a location last remembered by the DVD player. If the particular end user would like to return to watching television, remote control 14 can include a dedicated button (e.g., "Watch TV) that would deliver the end user back to a television-watching mode. In other examples, a simple dedicated button (e.g., labeled "EXIT") could be used as a default for returning to a given mode (e.g., watching television could be the default when the EXIT button is pressed).

Essentially, each of the buttons (similar to dedicated button 18) has the requisite intelligence behind them to launch an AV selection process, as discussed herein. In order to improve the ease of use, in one implementation, each of buttons 40, 42, 44, and 46 are uniquely shaped (or provided with different textures or colors) to help automate (and/or identify) its intended operation for the end user.

In certain examples, each of these dedicated buttons can be used to trigger an operation that cycles through a loop to find the correct video source, and then subsequently deliver the end user to the opening menu screen of the associated program. From this point, the end user can simply navigate through that corresponding system (e.g., select an appropriate chapter from a movie, select a videogame, select a feed from a remote TelePresence location, etc.). Thus, each of dedicated buttons 40, 42, 44, and 46 can have multiple activities associated with pressing each of them, namely: powering on one or more implicated devices, cycling through various potential AV inputs, identifying a correct input feed based on image recognition, and delivering the end user to a home screen, a menu, or some other desired location within the application.

Button 42 may be configured in a similar fashion such that a videogame console could be triggered upon pressing button 42. Again, the possible audiovisual inputs would be cycled through to find the correct video source such that a subsequent video game could be played. Buttons 44 and 46 could involve different applications, where a single press of these buttons could launch the application, as described above.

Remote control 14 may include any suitable hardware, software, components, modules, interfaces, or objects that facilitate the operations thereof. This may be inclusive of appropriate algorithms and communication protocols that allow for the effective image recognition and input verification, as discussed herein. In one example, some of these operations can be performed by image classifier module 30. As depicted in FIG. 2, remote control 14 can be equipped with appropriate software to execute the described verification and image recognition operations in an example embodiment of the present disclosure. Memory elements and processors (which facilitate these outlined operations) may be included in remote control 14 or be provided externally, or consolidated in any suitable fashion. The processors can readily execute code (software) for effectuating the activities described.

Remote control 14 can include memory element 48 for storing information to be used in achieving the image recognition and/or verification operations, as outlined herein. Additionally, remote control 14 may include processor 38 that can execute software or an algorithm to perform the image recognition and verification activities as discussed in this Specification. These devices may further keep information in any suitable memory element [random access memory (RAM), ROM, EPROM, EEPROM, ASIC, etc.], software, hardware, or in any other suitable component, device, element, or object where appropriate and based on particular needs. Any of the memory items discussed herein should be construed as being encompassed within the broad term 'memory element.' The image recognition could be provided in any database, register, control list, or storage structure: all of which can be referenced at any suitable timeframe. Any such storage options may be included within the broad term 'memory element' as used herein in this Specification. Similarly, any of the potential processing elements, modules, and machines described in this Specification should be construed as being encompassed within the broad term 'processor.'

Note that in certain example implementations, image recognition and verification functions outlined herein may be implemented by logic encoded in one or more tangible media (e.g., embedded logic provided in an application specific integrated circuit [ASIC], digital signal processor [DSP] instructions, software [potentially inclusive of object code and source code] to be executed by a processor, or other similar machine, etc.). In some of these instances, memory elements [as shown in FIG. 2] can store data used for the operations described herein. This includes the memory elements being able to store software, logic, code, or processor instructions that are executed to carry out the activities described in this Specification. A processor can execute any type of instructions associated with the data to achieve the operations detailed herein in this Specification. In one example, the processors [as shown in FIG. 2] could transform an element or an article (e.g., data) from one state or thing to another state or thing. In another example, the activities outlined herein may be implemented with fixed logic or programmable logic (e.g., software/computer instructions executed by a processor) and the elements identified herein could be some type of a programmable processor, programmable digital logic (e.g., a field programmable gate array [FPGA], an erasable programmable read only memory (EPROM), an electrically erasable programmable ROM (EEPROM)) or an ASIC that includes digital logic, software, code, electronic instructions, or any suitable combination thereof.

Figure 4:
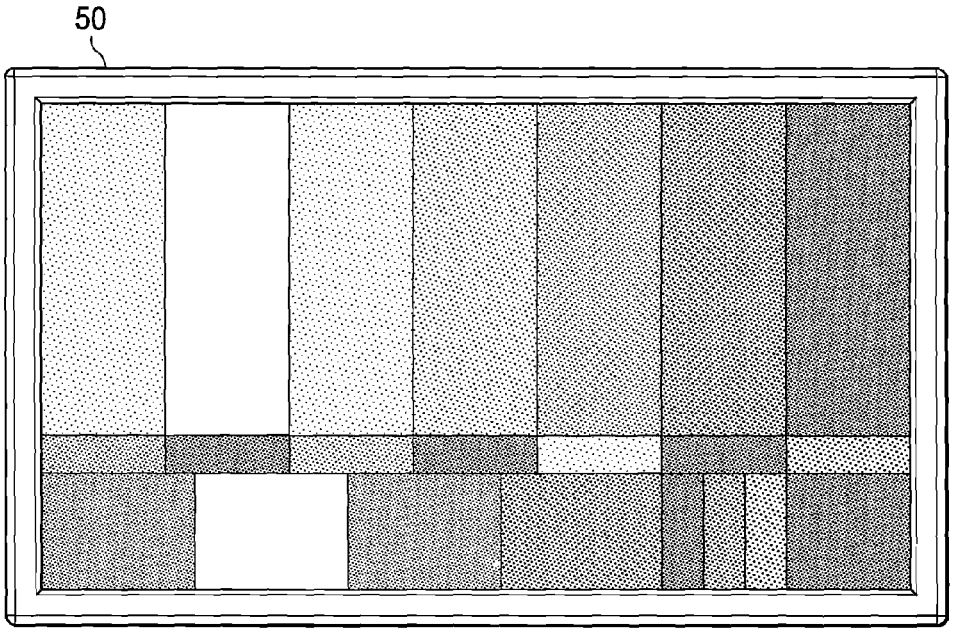
FIG. 4 is a simplified schematic of an example image in accordance with one example embodiment.

FIG. 4 is a simplified diagram depicting an image 50 from camera 16 of remote control 14. The image from camera 16 can be fed into a pattern recognition algorithm, which may be part of image classifier module 30. The detection of the presence or absence of a target test pattern can indicate to remote control 14 whether the desired state has been achieved in the end user's AV system. One or more test patterns may be stored within memory element 48 such that it can be accessed in order to find matches between a given pattern and image data being received by camera 16. For example, when remote control 14 is directed toward display 28, camera 16 may interface with camera optics element 34 to receive information from display 28. This information is matched against one or more patterns stored in memory element 48 (or stored in any other suitable location) in order to verify that the appropriate AV source is being rendered (i.e., delivered to) display 28.

A simple image processor (e.g., resident in image classifier module 30) can perform the requisite image recognition tasks when display 28 is in the field of view of camera 16. Camera 16 can operate in conjunction with image classifier module 30 to verify that commands or signals sent to a display had actually been received and processed. Camera 16 could further be used to determine if scan rates are compatible between source and monitor. In one example implementation, audiovisual device 24 is a consumer video device that is sold with remote control 14, which may be preprogrammed with predefined images and the correct infrared codes to adjust the television. In this particular consumer device example, remote control 14 includes an inexpensive, low-fidelity digital camera to be used in the operations discussed herein.

Once suitably powered (e.g., with batteries or some other power source), remote control 14 can begin sending control commands to a television in a repeating loop for AV inputs. At the same time, a given video device connected to the television can display a preselected high contrast pattern such as alternating black-and-white bars, as shown in FIG. 4. Camera 16 is able to recognize such a pattern with simple, fast image-processing techniques (e.g., pixel value histograms of sub-images, other suitable pattern matching technologies, etc.). When the displayed image is recognized as matching a stored test pattern for the associated (selected) audiovisual application, the adjustment loop is terminated. The correct audiovisual application input has been verified and the end user can continue in a normal fashion with the application.

Figure 5:
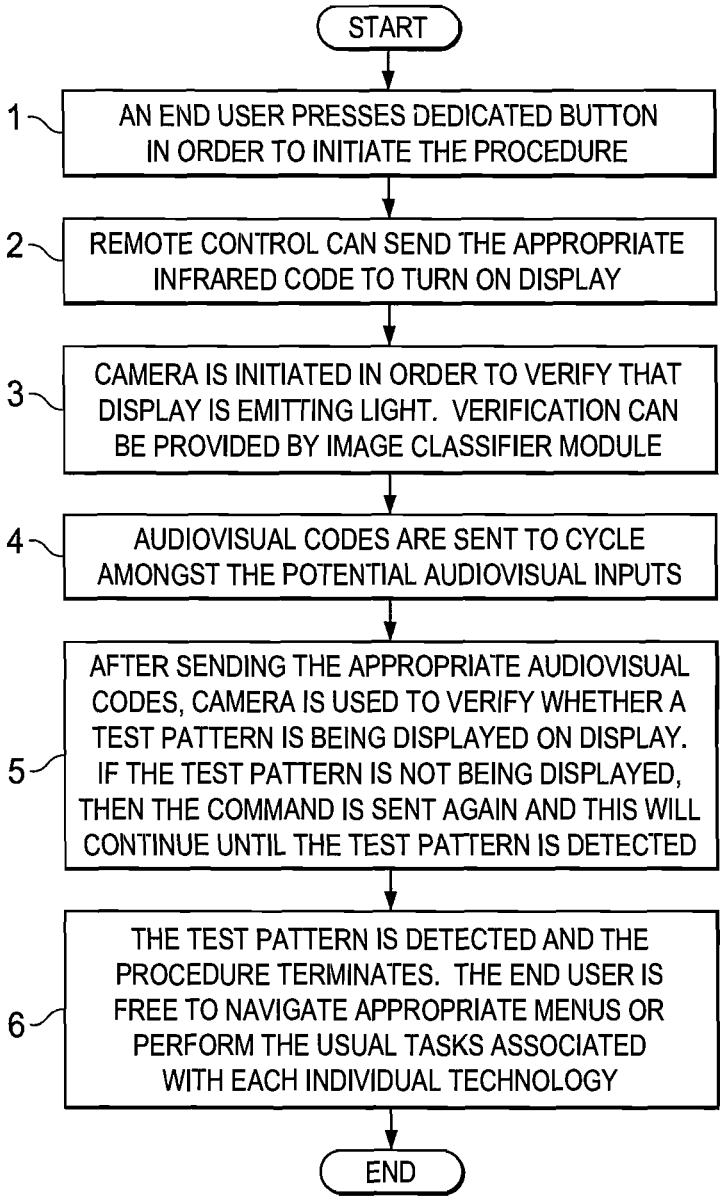
FIG. 5 is a simplified flowchart illustrating a series of example steps associated with the system.

FIG. 5 is a simplified flowchart illustrating an example set of operations that may be performed by remote control 14. This example considers an end user seeking to control audiovisual device 24, which represents one of a potential multitude of different inputs being fed to display 28. The objective in this simple procedure is to turn on display 28 and to find the right AV source to render onto display 28. At step one, an end user simply presses dedicated button 18 in order to initiate the procedure. At step two, remote control 14 can send the appropriate infrared code to turn on display 28. At step three, camera 16 is initiated in order to verify that display 28 is emitting light. This verification can be part of the capabilities provided by image classifier module 30.

At step four, AV codes are sent to remote control 14 to cycle amongst the potential AV inputs. After sending the appropriate AV codes, camera 16 is used to verify whether a test pattern is being displayed on display 28 at step five. If the test pattern is not being displayed, then the AV codes (e.g., additional commands) are sent again and this will continue until the test pattern is detected. Note that some technologies can include a command for cycling amongst the various inputs. In such a case, image classifier module 30 may leverage this looping protocol in identifying the appropriate input being sought by the end user.

At step six, the test pattern is detected in this example by matching what is displayed as image data with what is stored as a test pattern image associated with a particular audiovisual application. Once these two items are properly matched, the procedure terminates. From this point, the end user is free to navigate appropriate menus or simply perform the usual tasks associated with each individual technology (for example, play a DVD movie, initiate a videogame, interface with TelePresence end users remotely, etc.). Note that one inherent advantage in such a protocol is that remote control 14 is designed to systematically send the input sequence until it sees confirmation of the testing pattern on display 28. Such activities would typically be performed repeatedly by an end user, and this needlessly consumes time.

Note that with the example provided above, as well as numerous other examples provided herein, interaction may be described in terms of two or three elements. However, this has been done for purposes of clarity and example only. In certain cases, it may be easier to describe one or more of the functionalities of a given set of flows by only referencing a limited number of elements. It should be appreciated that system 10 (and its teachings) are readily scalable and can accommodate a large number of electronic devices, as well as more complicated/sophisticated arrangements and configurations. Accordingly, the examples provided should not limit the scope or inhibit the broad teachings of system 10 as potentially applied to a myriad of other architectures.

It is also important to note that the steps discussed with reference to FIGS. 1-5 illustrate only some of the possible scenarios that may be executed by, or within, system 10. Some of these steps may be deleted or removed where appropriate, or these steps may be modified or changed considerably without departing from the scope of the present disclosure. In addition, a number of these operations have been described as being executed concurrently with, or in parallel to, one or more additional operations. However, the timing of these operations may be altered considerably. The preceding operational flows have been offered for purposes of example and discussion. Substantial flexibility is provided by system 10 in that any suitable arrangements, chronologies, configurations, and timing mechanisms may be provided without departing from the teachings of the present disclosure.

Although the present disclosure has been described in detail with reference to particular embodiments, it should be understood that various other changes, substitutions, and alterations may be made hereto without departing from the spirit and scope of the present disclosure. For example, although the present disclosure has been described as operating in audiovisual environments or arrangements, the present disclosure may be used in any communications environment that could benefit from such technology. Virtually any configuration that seeks to intelligently cycle through input sources could enjoy the benefits of the present disclosure.

Moreover, although some of the previous examples have involved specific architectures related to consumer devices, the present disclosure is readily applicable to other video applications, such as the TelePresence platform. For example, the consumer (or business) TelePresence product could use this concept to automate turning on a display (e.g., a television) and switching to the right input when an incoming call is accepted, when an outgoing call is placed, when the user otherwise has signaled a desire to interact with the system, etc. For example, an end user may wish to configure the TelePresence AV system when prompted by an unscheduled external event (e.g., an incoming phone call). In operation, the end user can stand in front of display 28 and use remote control 14 when assenting to a full video TelePresence call. In an architecture where this is not the expected use case, camera 16 could be located elsewhere, for example in the charging cradle for a handset. The system could use an in-view placement of the cradle for the feature to be better supported. This could make the TelePresence technology even easier to use and manage.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112a as it exists on the date of the filing hereof unless the words "means for" or "step for" are specifically used in the particular claims; and (b) does not intend, by any statement in the specification, to limit this disclosure in any way that is not otherwise reflected in the appended claims.

What is claimed is:

1. A method, comprising:

cycling through a plurality of codes to turn on a display, wherein after each cycle a current code is determined and a remote control with a camera uses the camera to help determine if the display is emitting light;

storing the current code used in the cycle after verifying that the display is emitting light;

communicating a code to initiate cycling through a plurality of potential audiovisual inputs;

receiving, at the camera, image data that is rendered on the display, the image data being based on and unique to a first one of the audiovisual inputs; and comparing the image data of the first one of the audiovisual inputs to a stored test pattern image associated with a selected audiovisual application to verify if the image data matches the stored test pattern image for the selected audiovisual application.

2. The method of claim 1, wherein the cycling through of the plurality of potential audiovisual inputs is terminated if the image data matches the stored test pattern for the selected audiovisual application.

3. The method of claim 1, wherein the code represents one or more infrared audiovisual commands being repeatedly sent to the display.

4. The method of claim 3, wherein the commands are sent until the stored test pattern image is rendered and detected on the display.

5. The method of claim 1, wherein the selected audiovisual application is part of a group of audiovisual applications, the group consisting of:

a) a videogame application;

b) a videocassette recorder (VCR) application;

c) a digital video disc (DVD) player application;

d) a digital video recorder (DVR) application;

e) an audiovisual switchbox application; and f) an audiovisual receiver application.

6. The method of claim 1, wherein the stored test pattern image is stored in a memory element that includes a plurality of test pattern images corresponding to particular audiovisual applications.

7. Logic encoded in one or more tangible media that includes code for execution and when executed by a processor operable to perform operations comprising:

cycling through a plurality of codes to turn on a display, wherein after each cycle a current code is determined and a remote control with a camera uses the camera to help determine if the display is emitting light;

storing the current code used in the cycle after verifying that the display is emitting light;

communicating a code to initiate cycling through a plurality of potential audiovisual inputs;

receiving, at the camera, image data that is rendered on the display, the image data being based on and unique to a first one of the audiovisual inputs; and comparing the image data of the first one of the audiovisual inputs to a stored test pattern image associated with a selected audiovisual application to verify if the image data matches the stored test pattern image for the selected audiovisual application.

8. The logic of claim 7, wherein the cycling through of the plurality of potential audiovisual inputs is terminated if the image data matches the stored test pattern for the selected audiovisual application.

9. The logic of claim 7, wherein the code represents one or more infrared audiovisual commands being repeatedly sent to the display.

10. The logic of claim 9, wherein the commands are sent until the stored test pattern image is detected on the display.

11. The logic of claim 7, wherein the stored test pattern image is stored in a memory element that includes a plurality of images corresponding to particular audiovisual applications.

12. An apparatus, comprising:

a memory element configured to store data, a processor operable to execute instructions associated with the data, and an image classifier module configured to interact with the processor in order to:

cycle through a plurality of codes to turn on a display, wherein after each cycle a current code is determined and a remote control with a camera uses the camera to help determine if the display is emitting light;

store the current code used in the cycle after verifying that the display is emitting light;

communicate a code to initiate cycling through a plurality of potential audiovisual inputs;

receive, at the camera on a remote control, image data that is rendered on the display, the image data being based on and unique to a first one of the audiovisual inputs; and compare the image data of the first one of the audiovisual inputs to a stored test pattern image associated with a selected audiovisual application to verify if the image data matches the stored test pattern image for the selected audiovisual application.

13. The apparatus of claim 12, wherein the cycling through of the plurality of potential audiovisual inputs is terminated if the image data matches the stored test pattern for the selected audiovisual application.

14. The apparatus of claim 12, wherein the code represents one or more infrared audiovisual commands being repeatedly sent to the display.

15. The apparatus of claim 14, wherein the commands are sent until the stored test pattern image is detected on the display.

16. The apparatus of claim 12, further comprising:

an infrared emitter configured to interface with the image classifier module and to communicate the code to the display.

17. The apparatus of claim 12, wherein the stored test pattern image is stored in a memory element that includes a plurality of test pattern images corresponding to particular audiovisual applications.

18. The apparatus of claim 12, further comprising:

a lens optics element configured to interface with the image classifier module in order to deliver the image data to the image classifier module.

19. The method of claim 1, wherein the stored test pattern image is located in a database in the remote control and the database can be updated with a new test pattern image.

20. The logic of claim 7, wherein the stored test pattern image is located in a database in the remote control and the database can be updated with a new test pattern image.

* * * * *